US007117828B2

(12) United States Patent
Shuttleworth

(10) Patent No.: US 7,117,828 B2
(45) Date of Patent: Oct. 10, 2006

(54) AXIAL MOTORS

(75) Inventor: Richard Jack Shuttleworth, Nelson (NZ)

(73) Assignee: Shuttleworth Axial Motor Company Limited, Nelson (NL)

( * ) Notice: Subject to any disclaimer, the term of this patent is extended or adjusted under 35 U.S.C. 154(b) by 0 days.

(21) Appl. No.: 10/484,590

(22) PCT Filed: Jul. 23, 2002

(86) PCT No.: PCT/NZ02/00126

§ 371 (c)(1),
(2), (4) Date: Aug. 16, 2004

(87) PCT Pub. No.: WO03/010417

PCT Pub. Date: Feb. 6, 2003

(65) Prior Publication Data

US 2004/0255881 A1 Dec. 23, 2004

(30) Foreign Application Priority Data

Jul. 25, 2001 (NZ) ..... 513155

(51) Int. Cl.
*F02B 75/18* (2006.01)

(52) U.S. Cl. ..... 123/56.3; 123/56.5

(58) Field of Classification Search ..... 123/56.3, 123/56.5, 56.8

See application file for complete search history.

(56) References Cited

U.S. PATENT DOCUMENTS 2,097,138 A 10/1937 Steele
3,261,216 A 7/1966 Woolfenden
3,319,874 A 5/1967 Welsh et al.
3,528,294 A 9/1970 Cummins
3,654,906 A 4/1972 Airas
3,678,807 A 7/1972 Papst
3,760,692 A 9/1973 Molly
3,805,524 A 4/1974 Bachmann
3,901,093 A 8/1975 Brille
3,939,717 A 2/1976 Teisen
3,939,809 A 2/1976 Rohs
3,943,895 A 3/1976 Howell
4,003,352 A 1/1977 Rogojew
4,023,542 A 5/1977 Ango
4,066,049 A 1/1978 Teodorescu et al.
4,073,603 A 2/1978 Abendschein et al.
4,077,269 A 3/1978 Hodgkinson
4,090,478 A 5/1978 Trimble et al.
4,106,354 A 8/1978 Girodin
4,112,826 A 9/1978 Cataldo (Continued)

FOREIGN PATENT DOCUMENTS

AU 18057 6/1934

(Continued)

*Primary Examiner*—John T. Kwon
(74) *Attorney, Agent, or Firm*—Dann, Dorfman, Herrell and Skillman, P.C.

(57) ABSTRACT

An axial motor (100) driven by opposed pistons/cylinder (101*a*–105*b*, 111*a*–115*b*) pairs arranged in a circular array about a central axis of the motor (100). The opposed pistons (101*a*, 101*b*; 102*a*, 102*b*; 103*a*, 103*b*; 104*a*, 104*b*; 105*a*, 105*b*) in each pair are linked by a corresponding connecting rod (106–110), which transfers the thrust from the pistons (101*a*–105*a*) to an output shaft via a power transmission apparatus (300) and z crank (114) arrangement. Reciprocating couplings disposed in the transmission apparatus (300) connect the connecting rods (106–110) to the apparatus (300). During operation, the reciprocating couplings oscillate to retain the connecting rods (106–110) substantially aligned with the corresponding piston pair to reduce side thrust on the pistons.

32 Claims, 24 Drawing Sheets

U.S. PATENT DOCUMENTS

Figure 1:
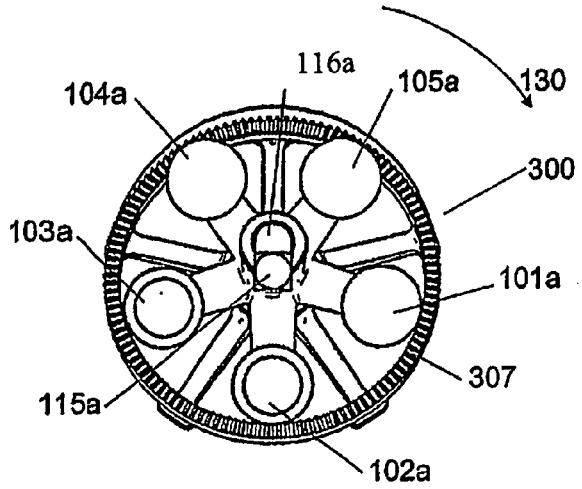
Figure 1:
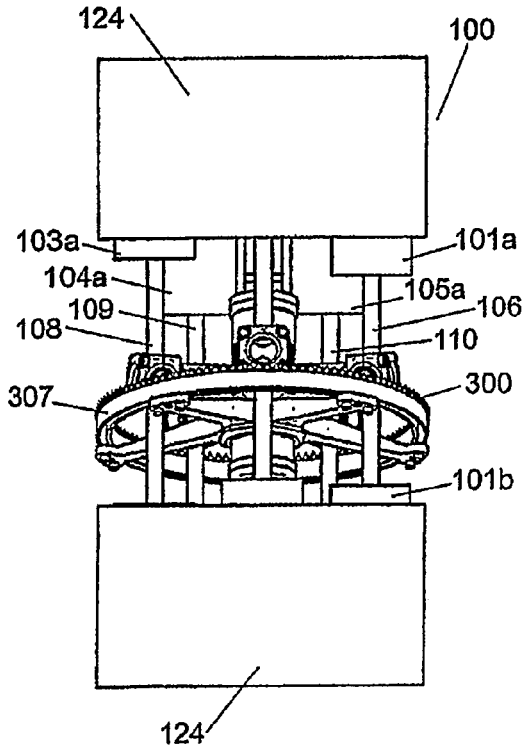
Figure 1:
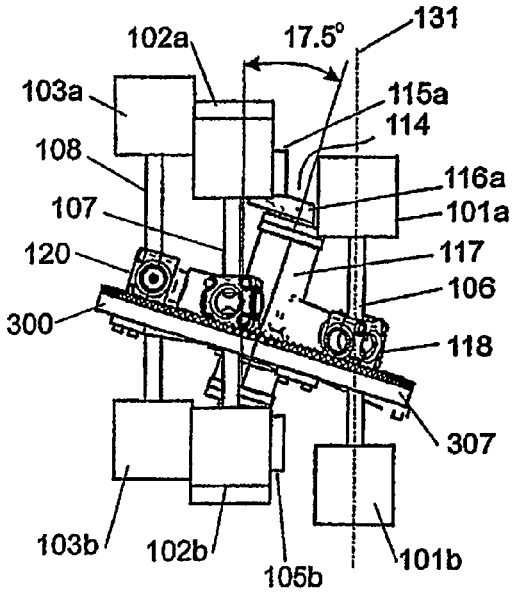
Figure 1:
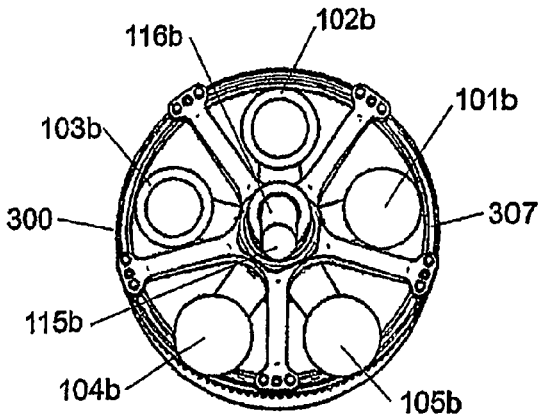

| | | | | | |
|---|---|---|---|---|---|
| 4,152,944 | A | | 5/1979 | Kemper | |
| 4,166,398 | A | * | 9/1979 | Girodin | 74/60 |
| 4,168,632 | A | | 9/1979 | Fokker | |
| 4,174,684 | A | | 11/1979 | Roseby et al. | |
| 4,203,396 | A | | 5/1980 | Berger | |
| 4,207,779 | A | | 6/1980 | Papst | |
| 4,285,303 | A | | 8/1981 | Leach | |
| 4,294,139 | A | | 10/1981 | Bex et al. | |
| 4,300,274 | A | | 11/1981 | Papst | |
| 4,433,596 | A | | 2/1984 | Scalzo | |
| 4,457,134 | A | | 7/1984 | Deutschmann | |
| 4,464,979 | A | | 8/1984 | Forster | |
| 4,489,682 | A | | 12/1984 | Kenny | |
| 4,492,188 | A | | 1/1985 | Palmer et al. | |
| 4,497,284 | A | | 2/1985 | Schramm | |
| 4,510,894 | A | | 4/1985 | Williams | |
| 4,513,630 | A | | 4/1985 | Pere et al. | |
| 4,515,113 | A | | 5/1985 | DeLorean | |
| 4,523,549 | A | | 6/1985 | Lacy | |
| 4,553,508 | A | | 11/1985 | Stinebaugh | |
| 4,565,103 | A | | 1/1986 | Brille | |
| 4,565,118 | A | | 1/1986 | Girodin | |
| 4,569,314 | A | | 2/1986 | Milu | |
| 4,622,927 | A | | 11/1986 | Wenker | |
| 4,736,715 | A | | 4/1988 | Larsen | |
| 4,781,152 | A | | 11/1988 | Pellerin | |
| 4,905,637 | A | | 3/1990 | Ott | |
| 4,974,555 | A | | 12/1990 | Hoogenboom | |
| 5,007,385 | A | | 4/1991 | Kitaguchi | |
| 5,016,580 | A | | 5/1991 | Gassman | |
| 5,027,755 | A | | 7/1991 | Henry, Jr. | |
| 5,027,756 | A | * | 7/1991 | Shaffer | 123/56.5 |
| 5,031,581 | A | | 7/1991 | Powell | |
| 5,033,358 | A | | 7/1991 | Molly | |
| 5,083,532 | A | | 1/1992 | Wiesen | |
| 5,094,146 | A | | 3/1992 | Molly | |
| 5,094,195 | A | | 3/1992 | Gonzalez | |
| 5,113,809 | A | | 5/1992 | Ellenburg | |
| 5,129,752 | A | | 7/1992 | Ebbing et al. | |
| 5,215,045 | A | * | 6/1993 | Vadnjal | 123/56.8 |
| 5,375,567 | A | | 12/1994 | Lowi, Jr. | |
| 5,442,971 | A | | 8/1995 | Romanchev et al. | |
| 5,517,953 | A | | 5/1996 | Wiesen | |
| 5,638,778 | A | | 6/1997 | James | |
| 5,678,471 | A | | 10/1997 | Ash, Jr. et al. | |
| 5,692,378 | A | | 12/1997 | Ramsden | |
| 5,709,176 | A | | 1/1998 | Llewellyn | |
| 5,740,765 | A | | 4/1998 | Ball et al. | |
| 5,992,357 | A | * | 11/1999 | Tasi | 123/56.2 |
| 6,354,083 | B1 | | 3/2002 | Shuttleworth et al. | |

FOREIGN PATENT DOCUMENTS

| | | |
|---|---|---|
| DE | 2838477 | 3/1980 |
| DE | 3043251 | 7/1982 |
| DE | 3416868 | 10/1984 |
| DE | 19538197 | 4/1997 |
| GB | 155400 | 6/1920 |
| GB | 1495948 | 12/1977 |
| GB | 2027122 | 2/1980 |
| GB | 1594347 | 7/1981 |
| GB | 2338746 | 12/1999 |
| NZ | 212574 | 12/1986 |
| NZ | 221366 | 1/1991 |
| SU | 1574832 | 6/1990 |
| WO | 9002247 | 3/1990 |
| WO | 9629506 | 9/1996 |
| WO | WO96/29506 | 9/1996 |
| WO | 9859160 | 12/1998 |

* cited by examiner

TOP PLAN

SIDE PLAN

SIDE ELEVATION

BOTTOM PLAN

UPPER PERSPECTIVE

SIDE ELEVATION

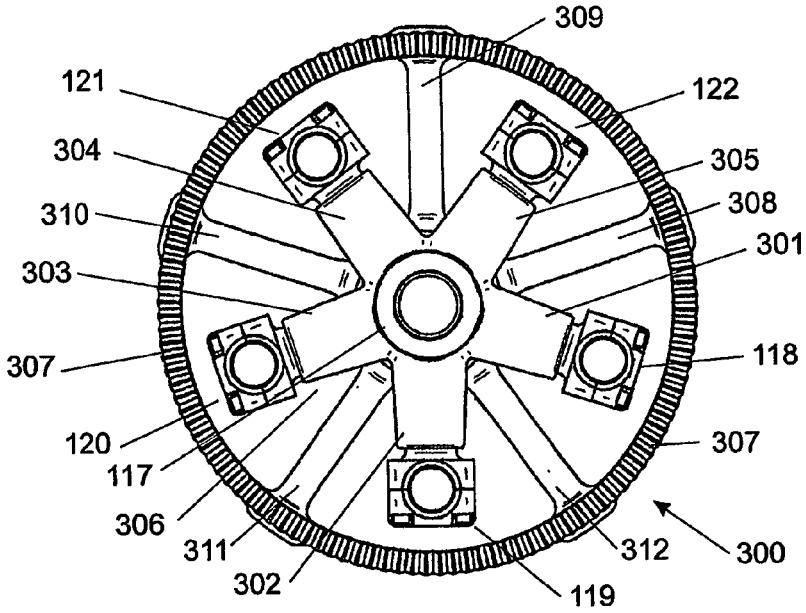
TOP PLAN
FIGURE 3
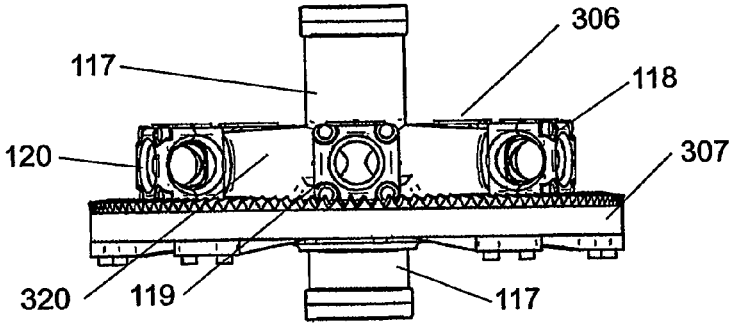
SIDE ELEVATION
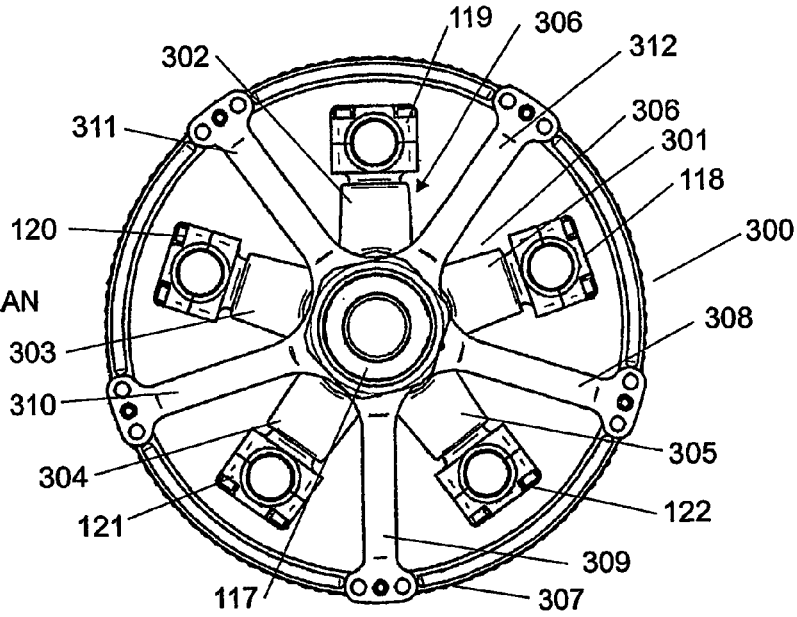
BOTTOM PLAN

UPPER PERSPECTIVE

LOWER PERSPECTIVE

AXIAL MOTORS

BACKGROUND TO THE INVENTION

This invention relates to power transmission apparatus for converting linear reciprocating motion into rotational motion and an axial motor using such an apparatus. The linear reciprocating motion can come from pistons, or the like, arranged in a circular configuration.

BACKGROUND TO THE INVENTION

Axial motors include an engine block in which the cylinders and pistons are arranged evenly in a circular configuration about a central axis of the engine block, rather than in the inline, "V" or horizontally opposed configurations of traditional engines. The reciprocal motion of the pistons in such a motor can be transferred to rotational motion of an output shaft by way of a wobble plate and z crank configuration such as that disclosed in NZ 221366, or by some other suitable transfer means. In later axial motors, such as those described in WO 96/29506 and GB 2,338,746, opposed pistons are used to increase the thrust on the transmission means.

In such motors, connecting rods, or some other suitable means, couple the pistons to the wobble plate to transfer thrust from the pistons to the z crank, or other means, to drive the output shaft. The connecting rods do not remain in a vertical orientation throughout the entire cycle due to the motion of the wobble plate, and this can create side thrust on various components of the engine, including the pistons.

SUMMARY OF THE INVENTION

It is an object of the invention to provide an improved axial motor, or alternatively to provide a power transfer apparatus for use in an axial motor, that reduces side thrust on the piston during operation.

In one aspect the present invention may be said to consist in an axial motor including: a plurality of reciprocating thrust means arranged as opposed pairs in a substantially circular array about a central axis, a connecting rod for each thrust means pair connecting the thrust means in that pair, each connecting rod coincident with an axis extending through the respective thrust means pair it connects, a z crank coupled between the ends of an output shaft extending substantially coincident with the central axis, a power transmission apparatus coupled to the z crank, a plurality of reciprocating couplings, each connected to or integrated with the transmission apparatus, and also connected to a corresponding connecting rod to transfer thrust from the corresponding thrust means to the z crank, wherein during operation, to reduce side thrust on thrust means, the reciprocating couplings move to compensate for movement in the transmission apparatus to retain each connecting rod substantially aligned with the axis extending through the respective thrust means pair it connects.

In another aspect the present invention may be said to consist in a power transfer apparatus adapted for transferring thrust from reciprocating thrust means arranged axially in opposed pairs to a z crank of an axial motor, the apparatus including: a z crank coupling for connecting the apparatus to a z crank, a plurality of coupling support arms extending radially from the z crank coupling, a plurality of reciprocating couplings, each reciprocating coupling disposed in a respective coupling support arm and adapted to oscillate within the respective support arm, wherein upon installation of the apparatus in an axial motor, each reciprocating coupling is adapted for connection to a connecting rod extending between one pair of opposed thrust means in the axial motor, and during operation of the motor, each reciprocating coupling is adapted to reduce side thrust on the thrust means pair, by oscillating to compensate for movement in the apparatus to retain each connecting rod substantially aligned with an axis extending through the respective thrust means pair it connects.

The reciprocating motion can be provided by a number of internal combustion cylinder/piston arrangements, solenoid or hydraulic rams, or any other suitable power thrust means that operates in a reciprocal motion. In the case of an internal combustion piston/cylinder application, the piston may be assembled in a modular fashion from carbon components.

BRIEF LIST OF FIGURES

Figure 2:
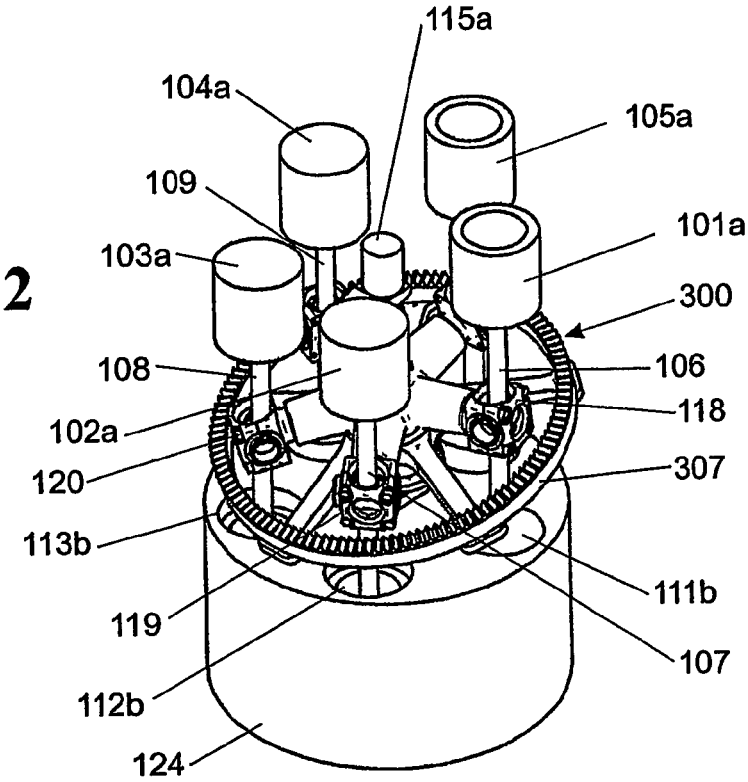
Figure 2:
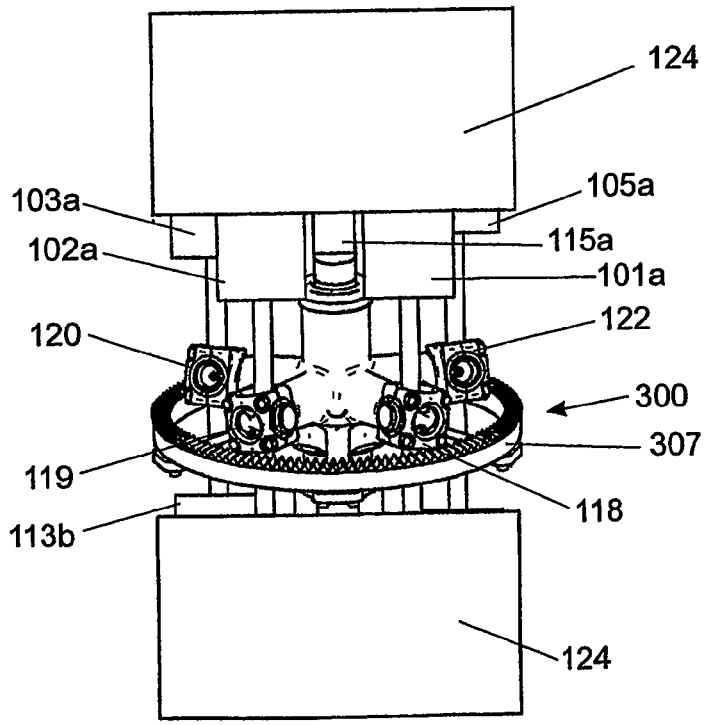
Figure 4:
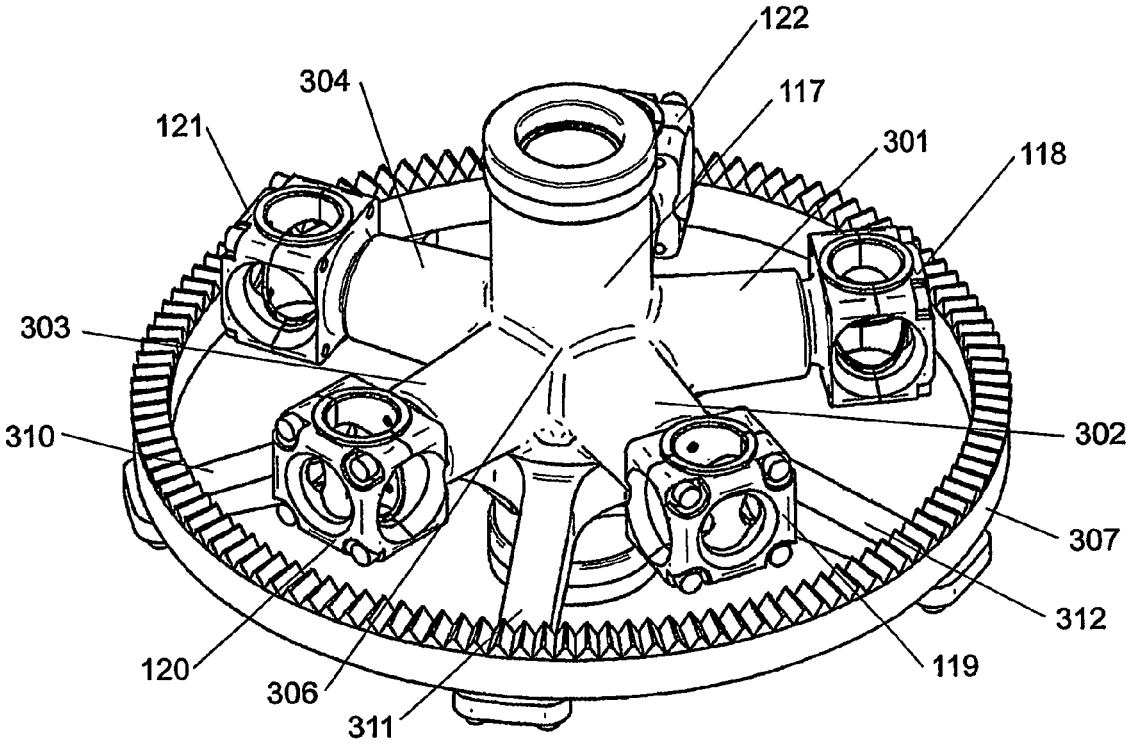
Figure 4:
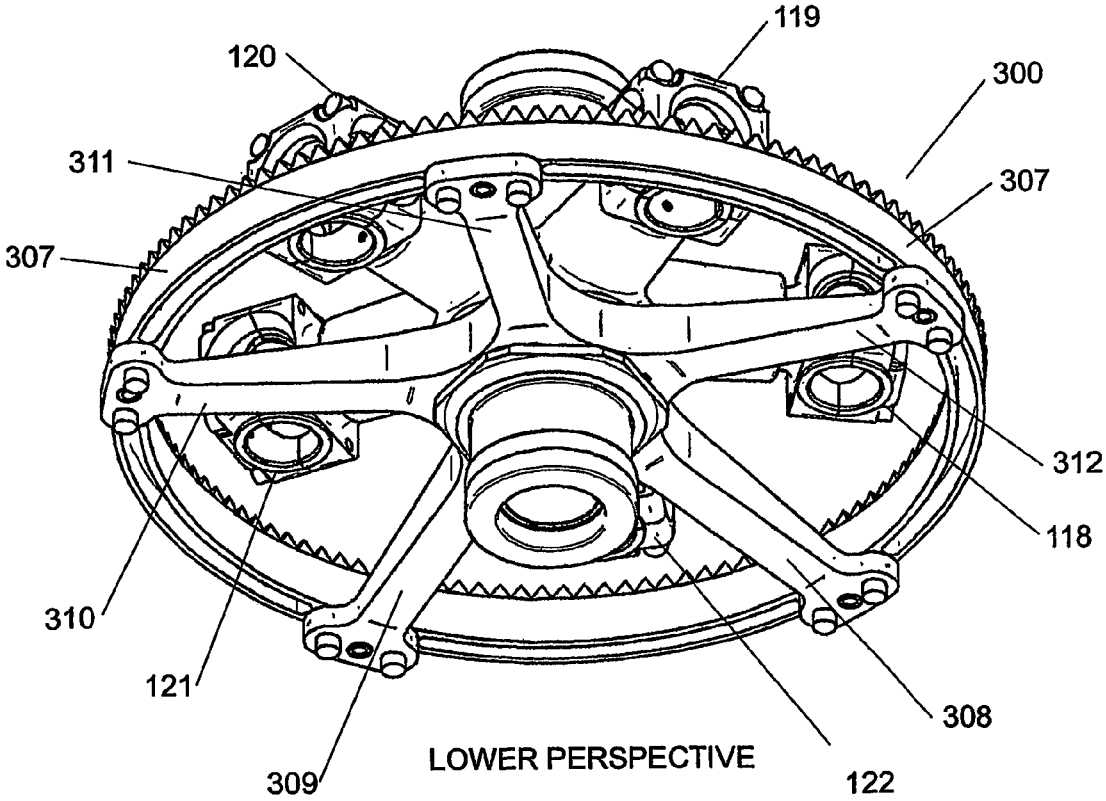
Figure 5A:
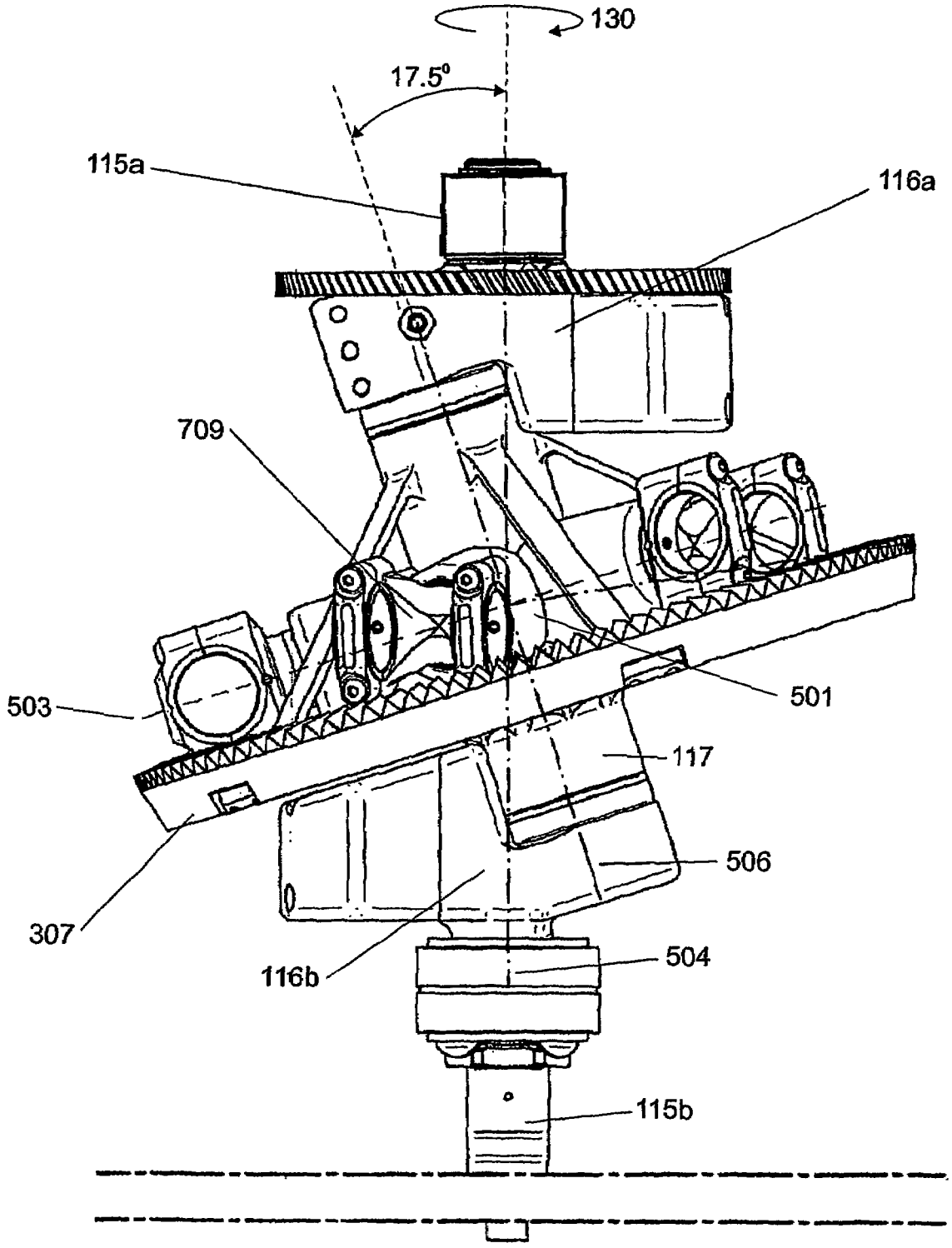
Figure 5B:
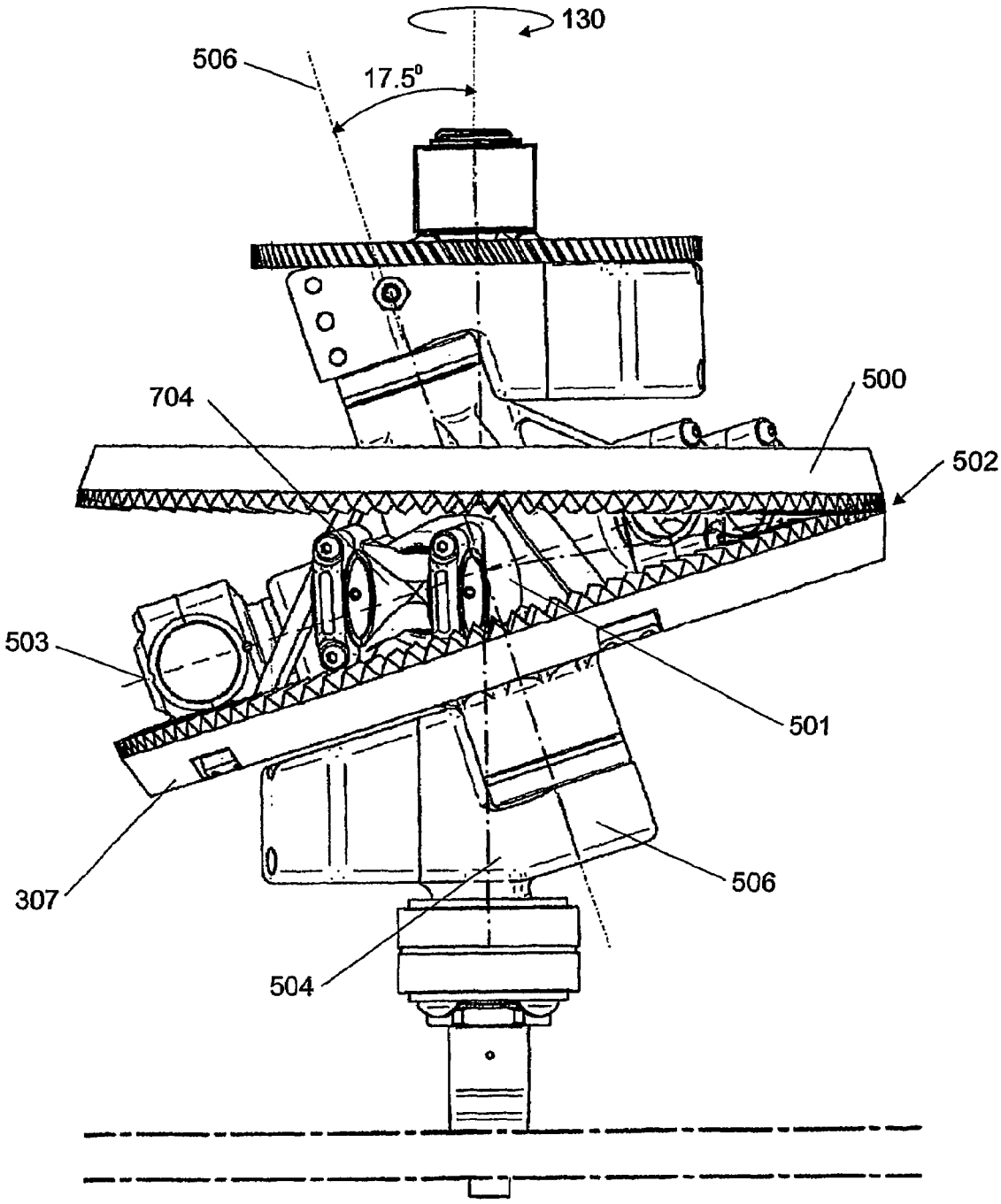
Figure 6:
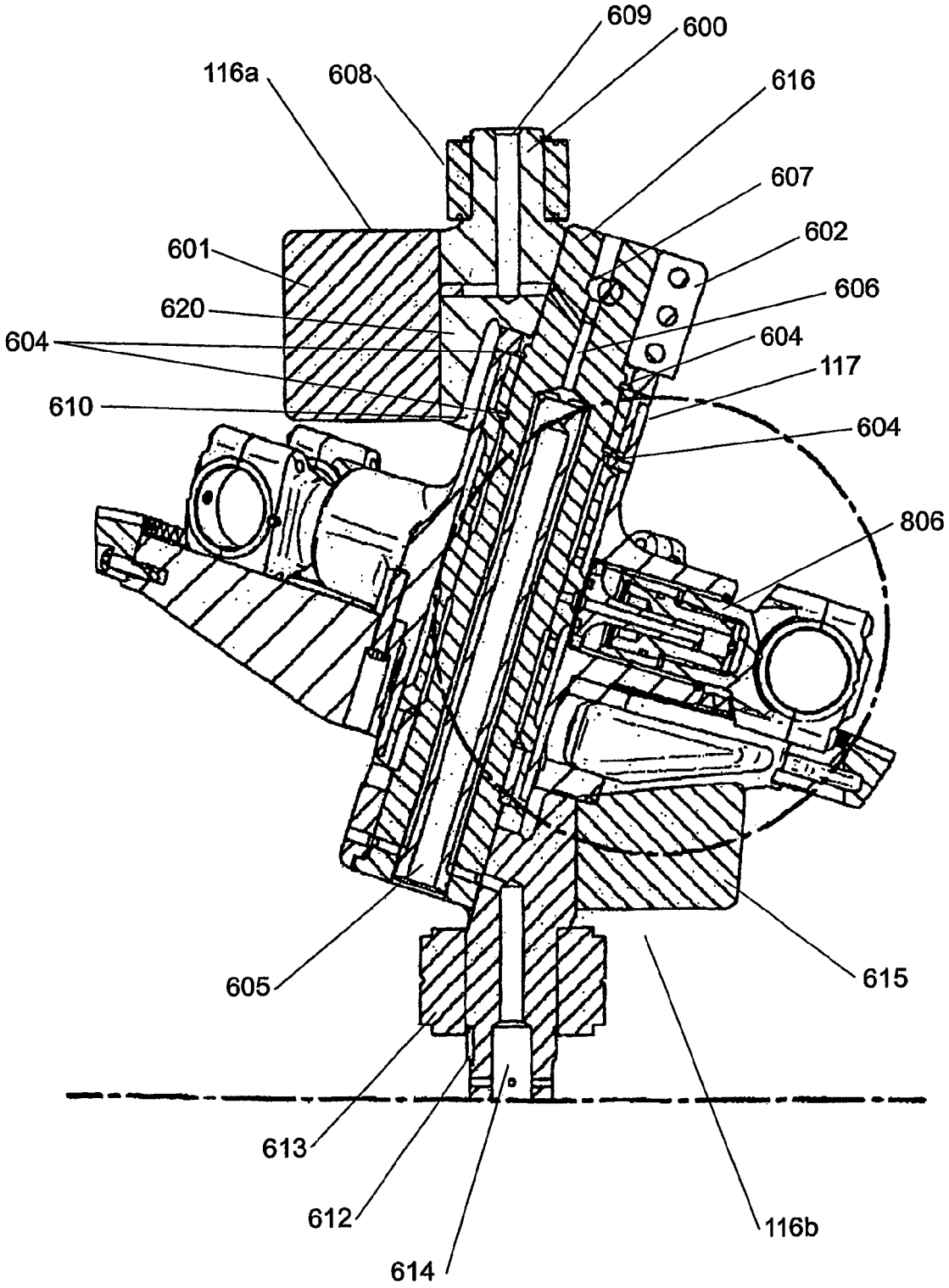
Figure 7A:
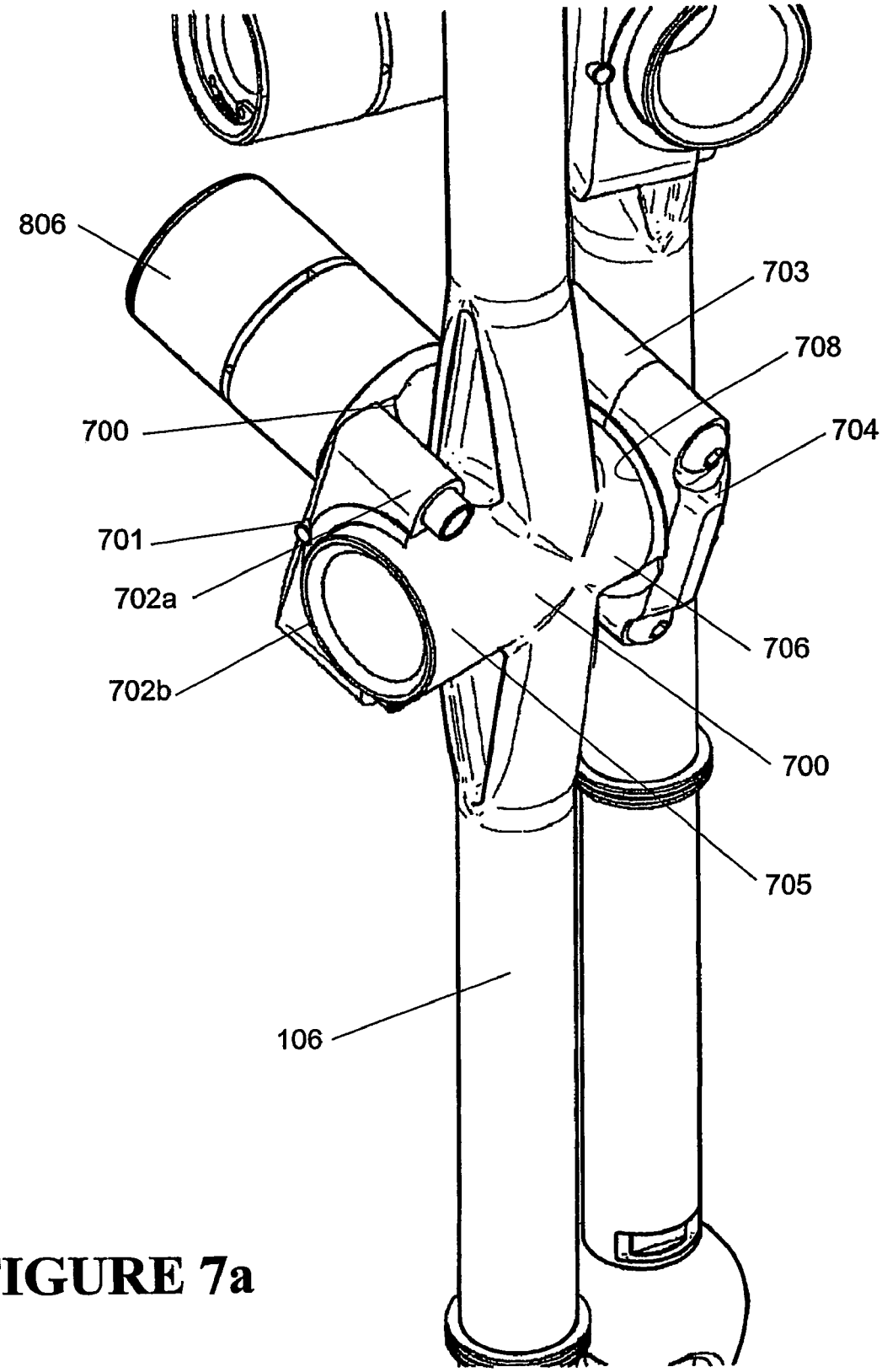
Figure 7B:
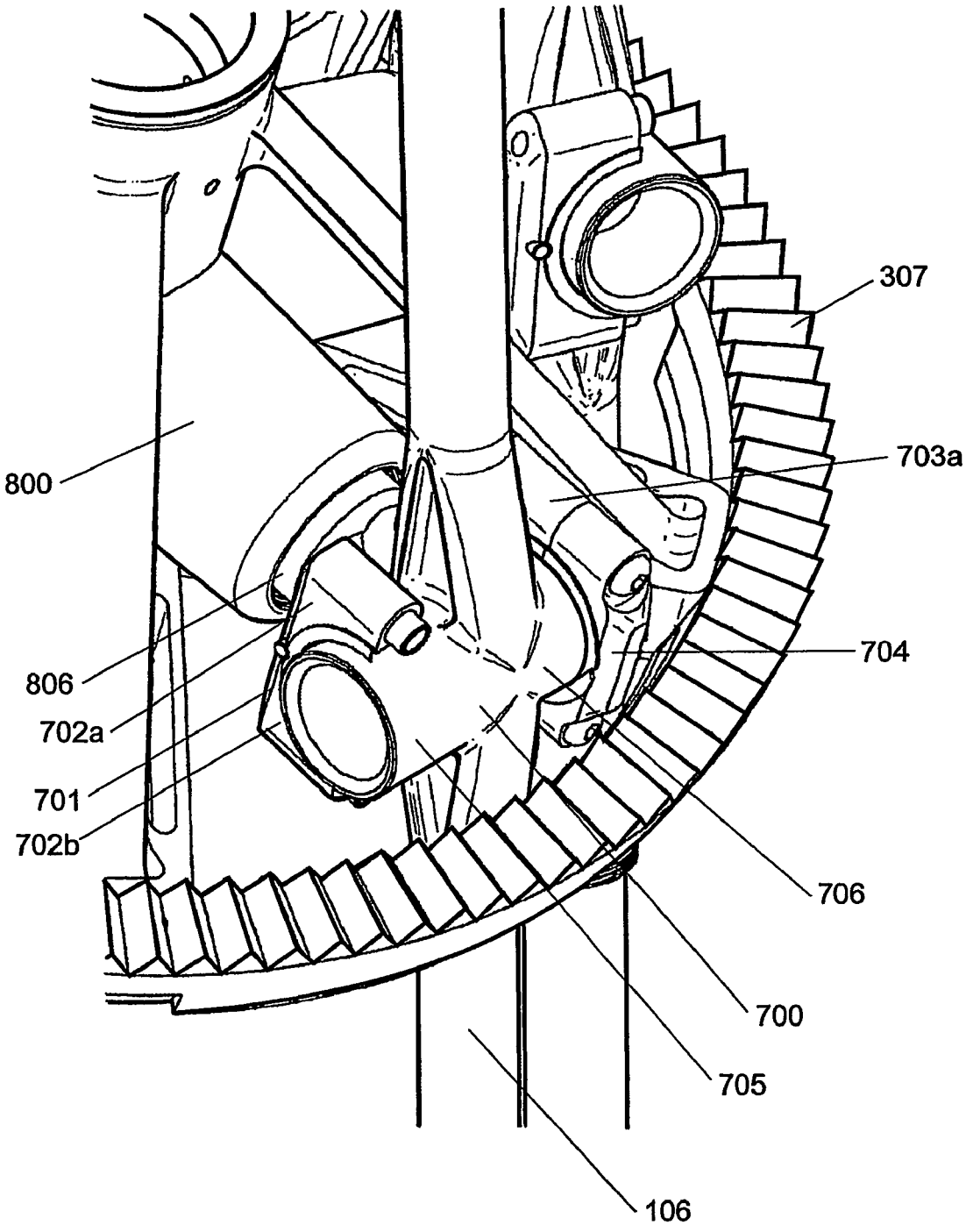
Figure 8A:
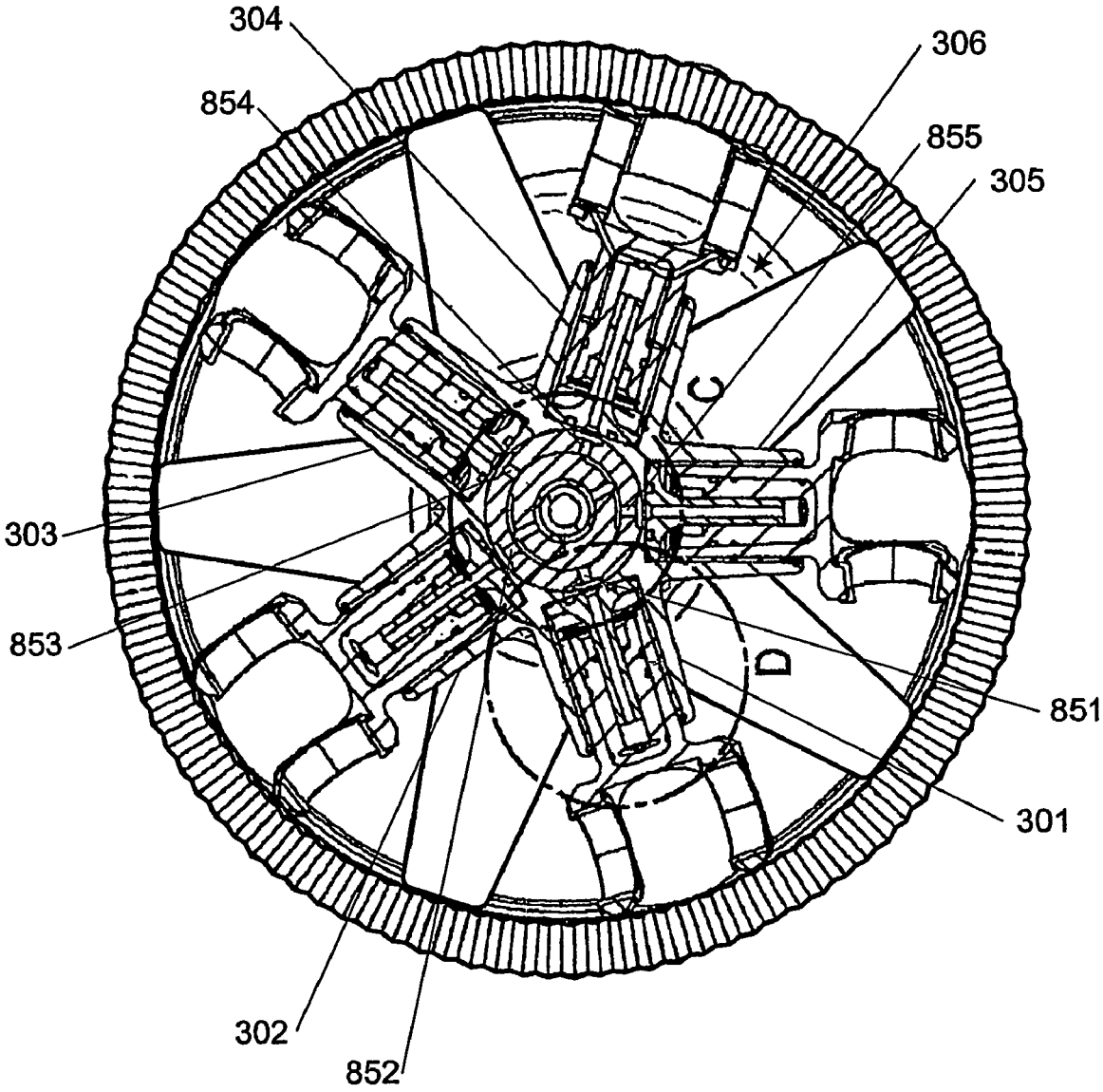
Figure 8B:
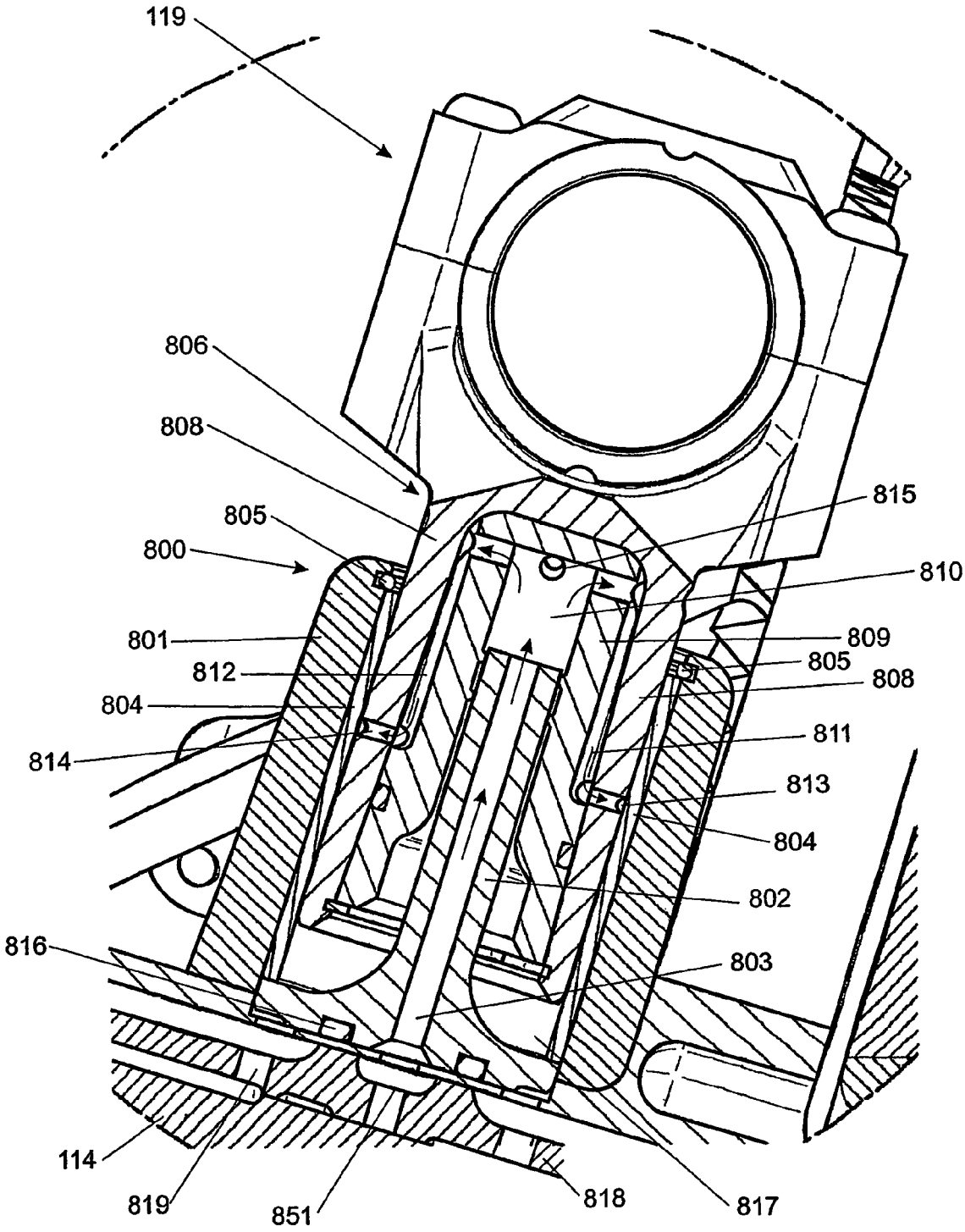
Figure 8C:
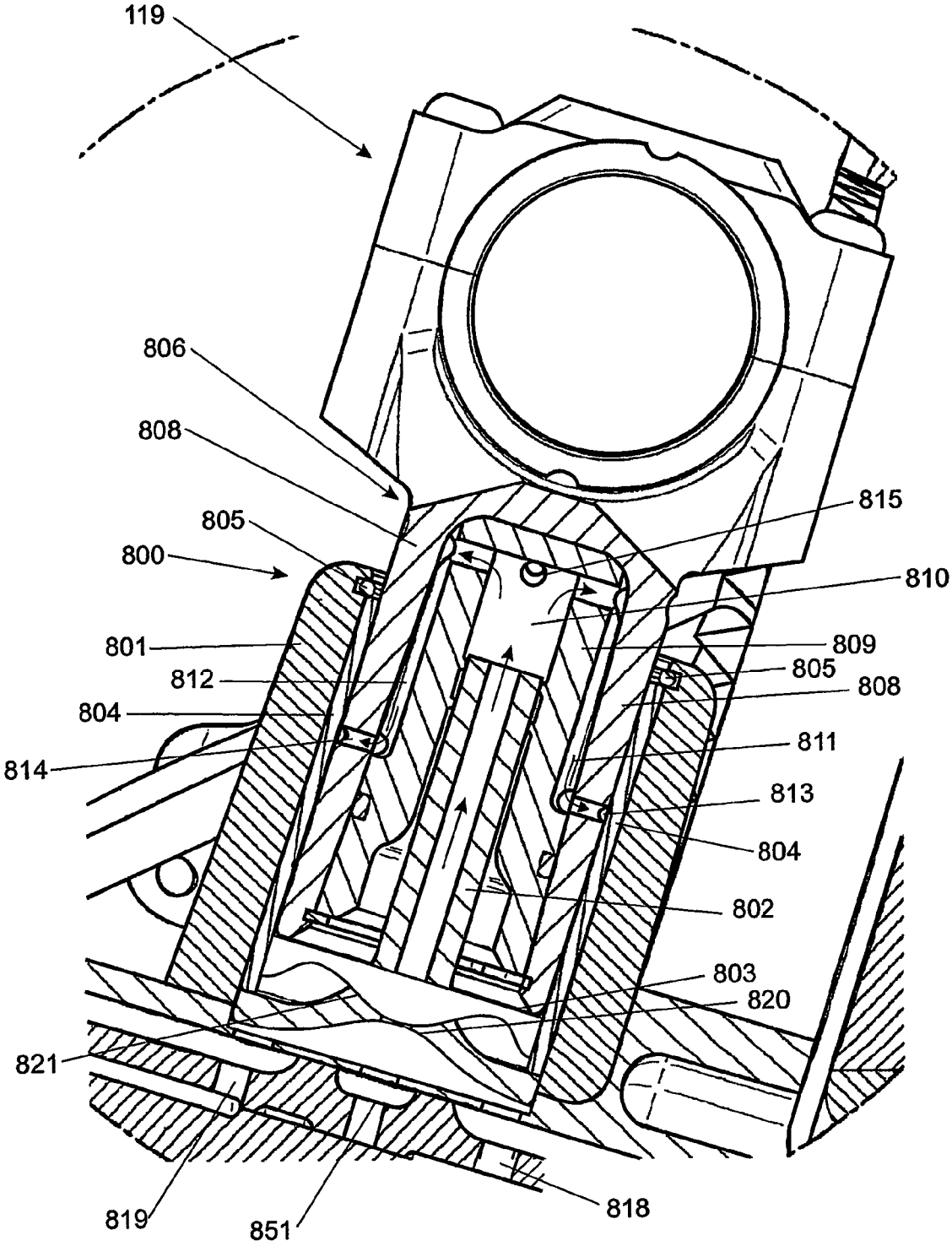
Figure 8D:
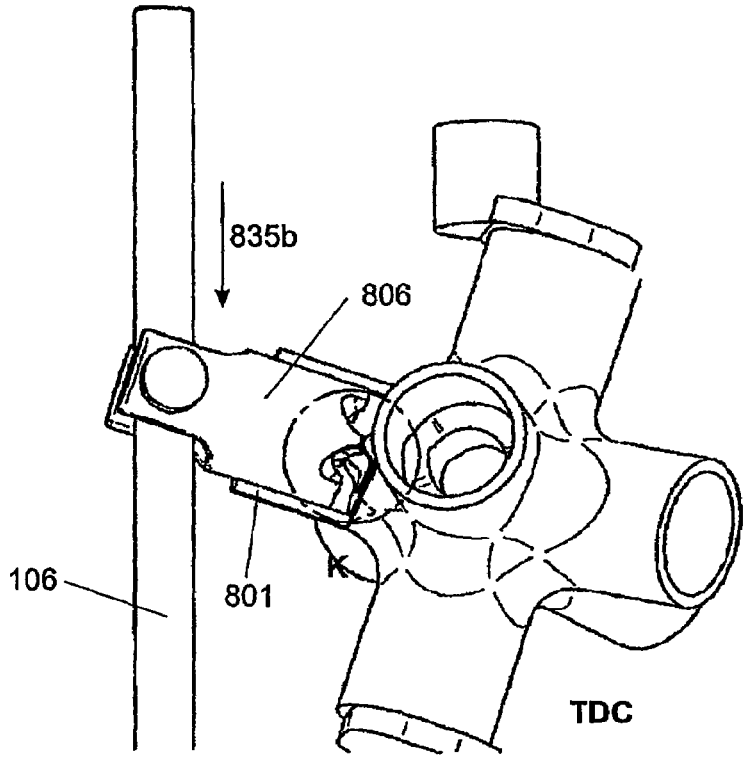
Figure 8E:
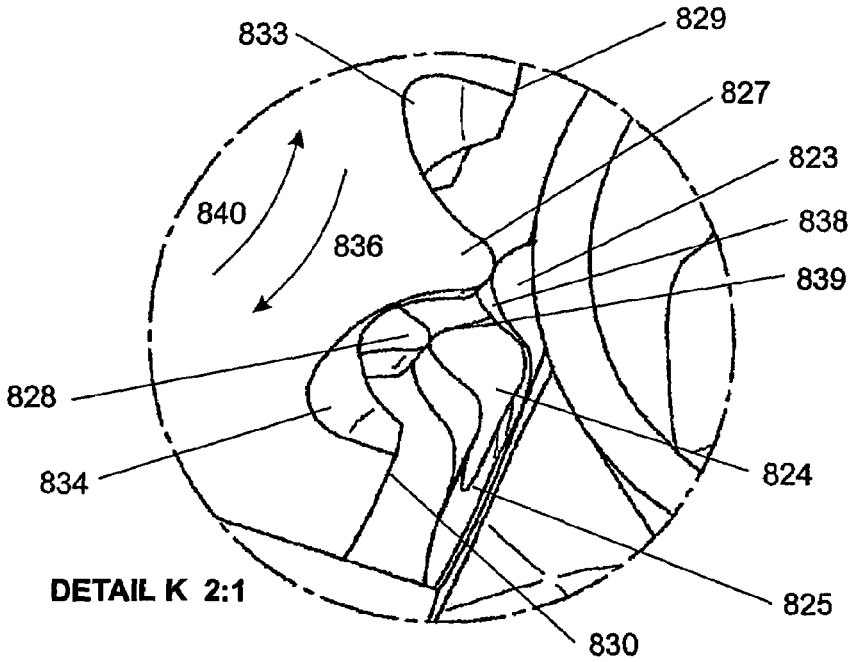
Figure 8F:
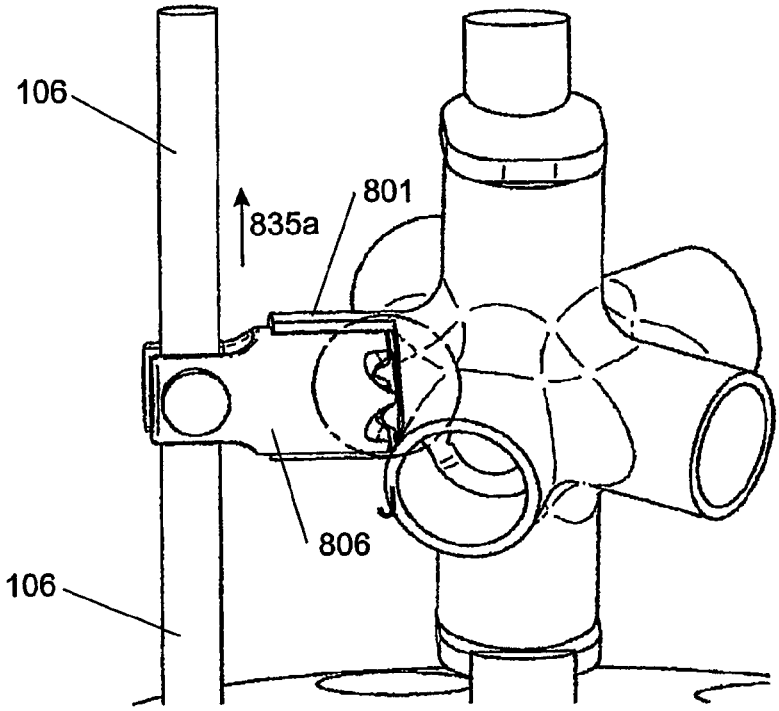
Figure 8G:
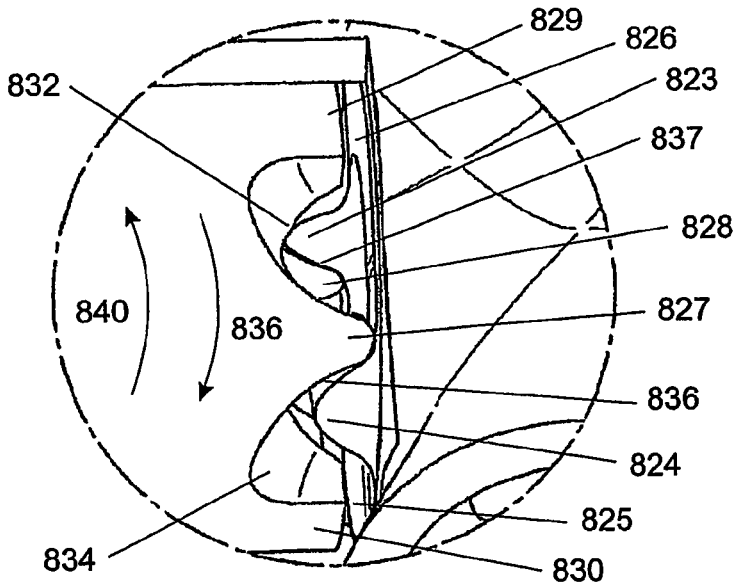
Figure 8H:
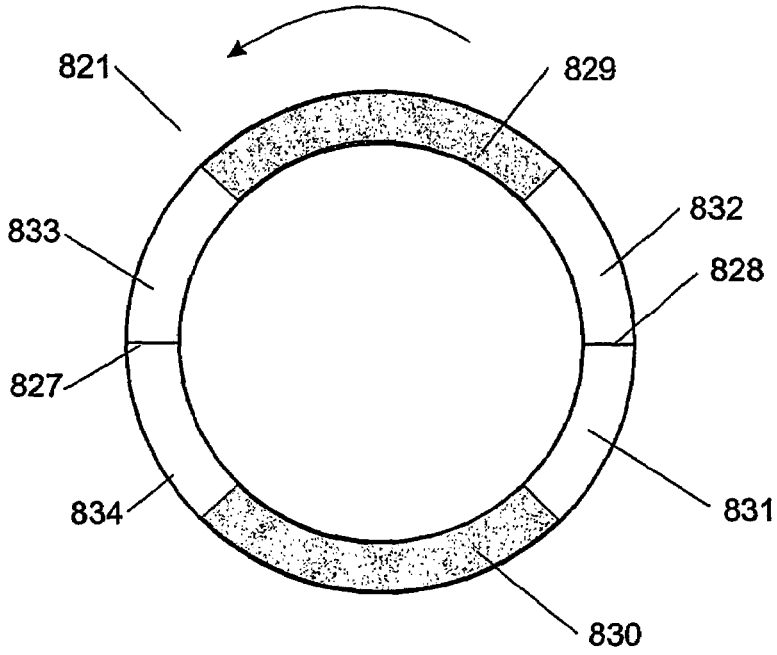
Figure 8I:
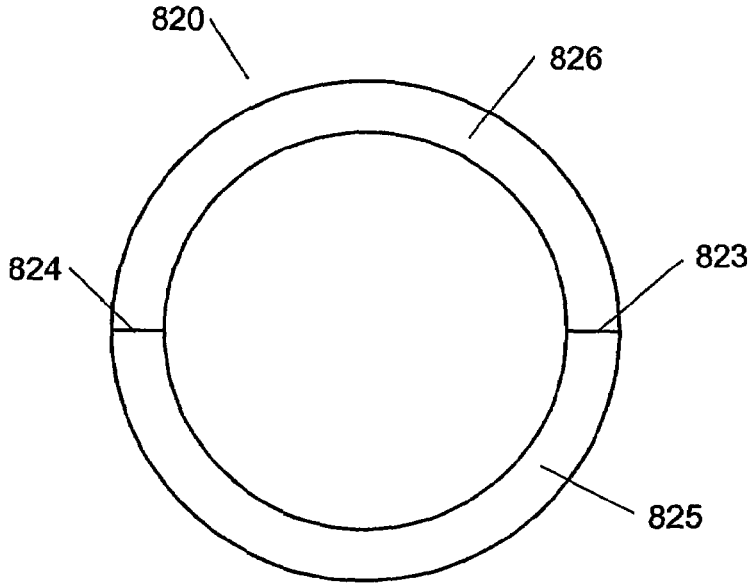
Figure 9:
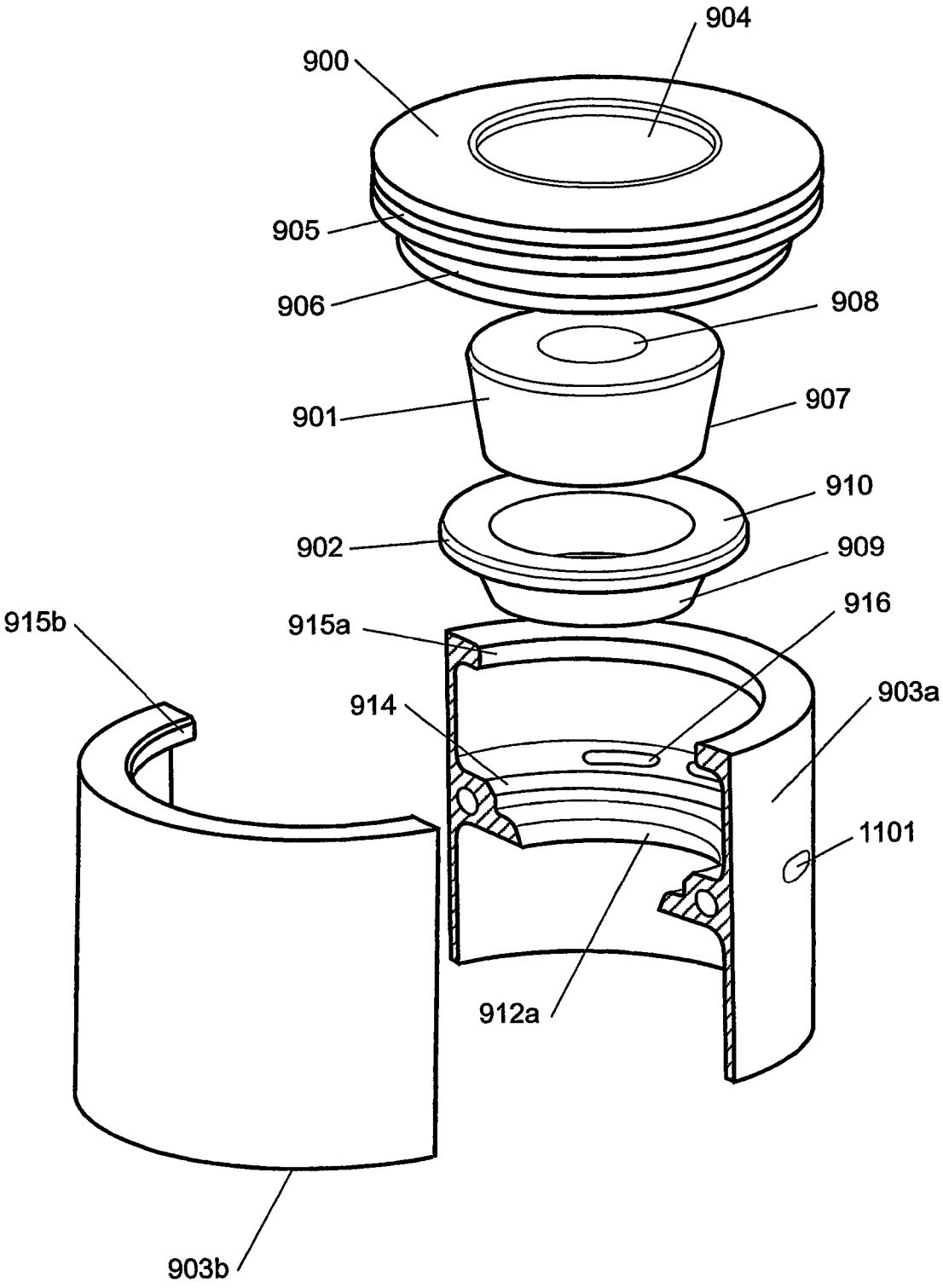
Figure 10A:
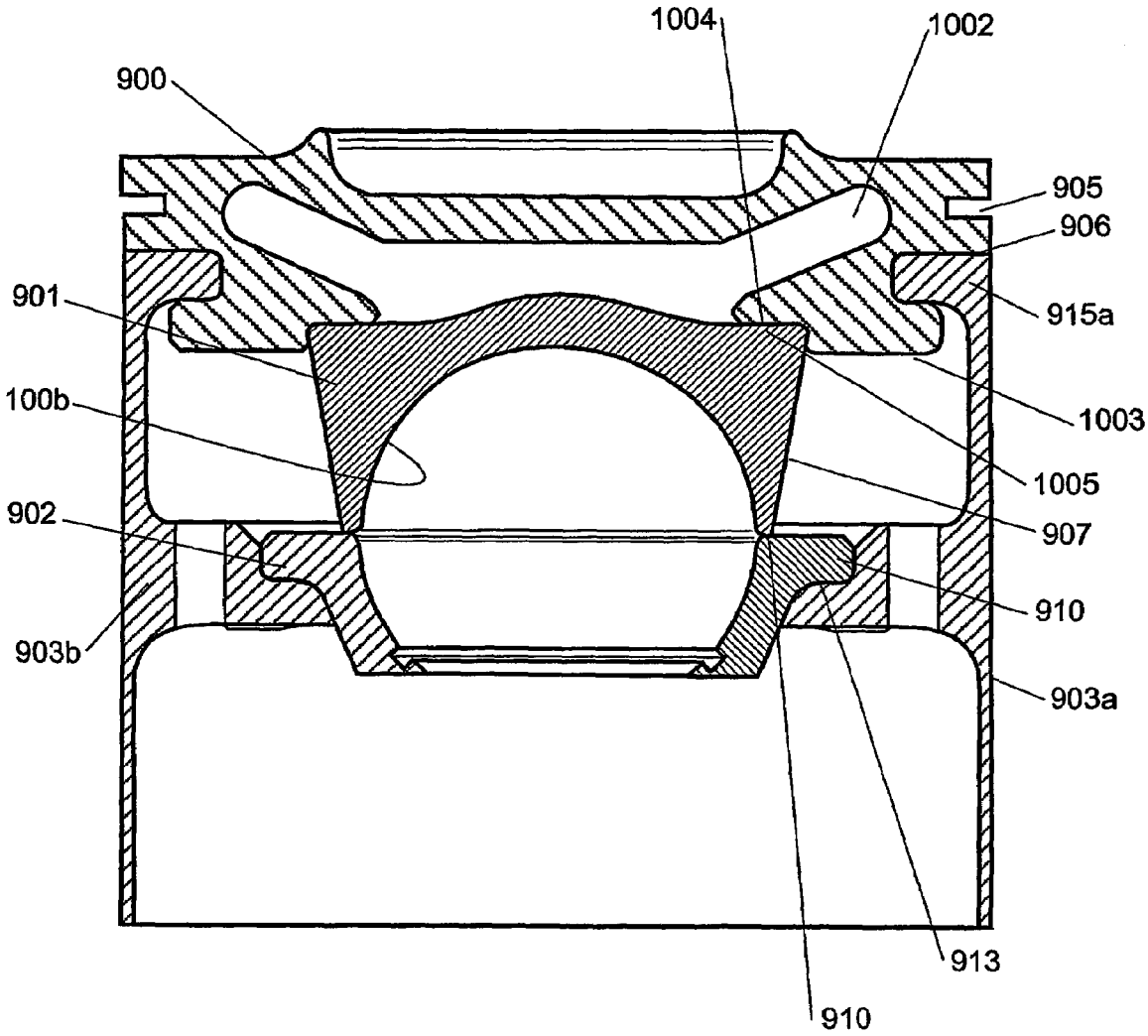
Figure 10B:
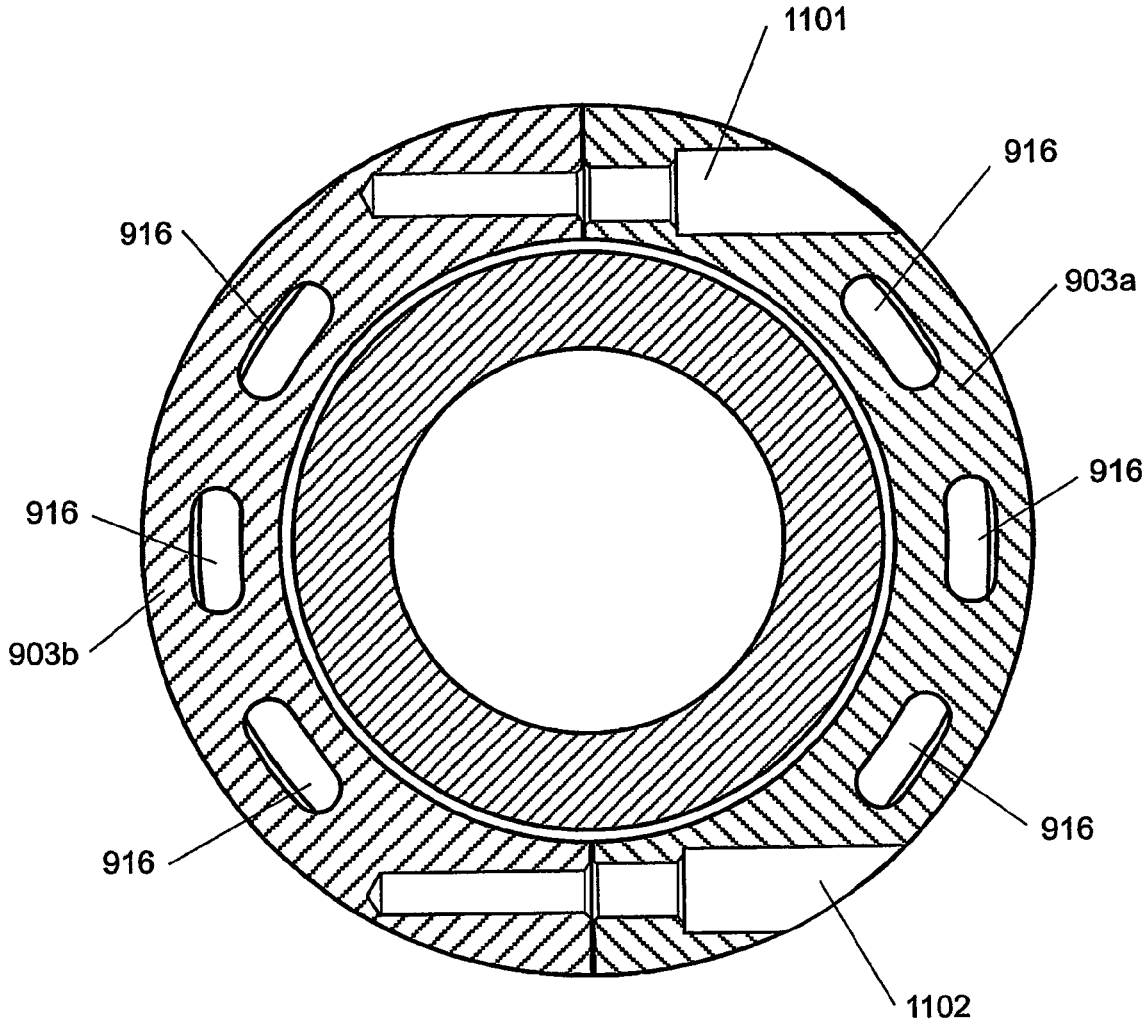
Figure 11A:
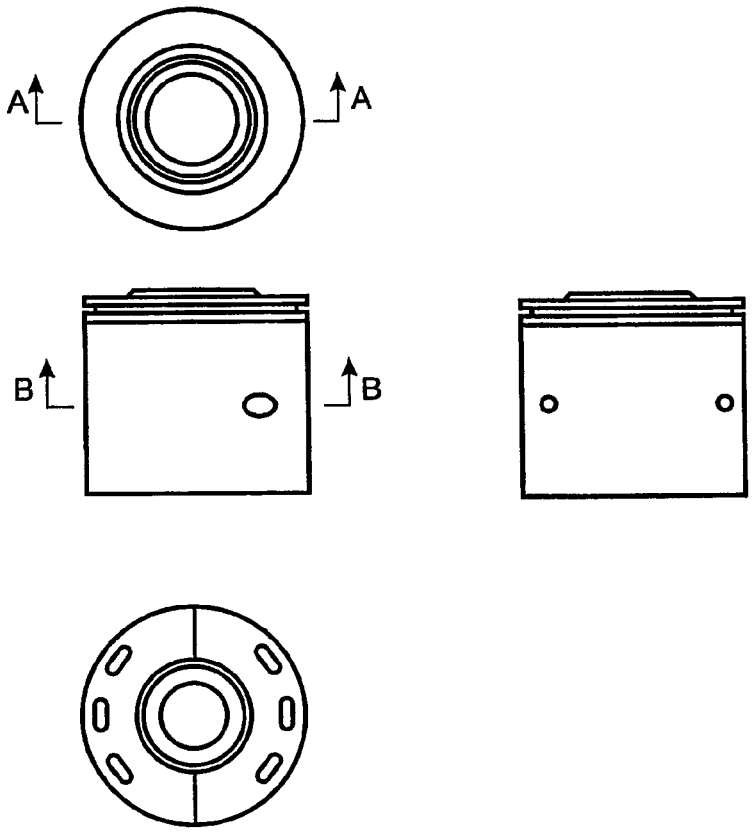
Figure 11B:
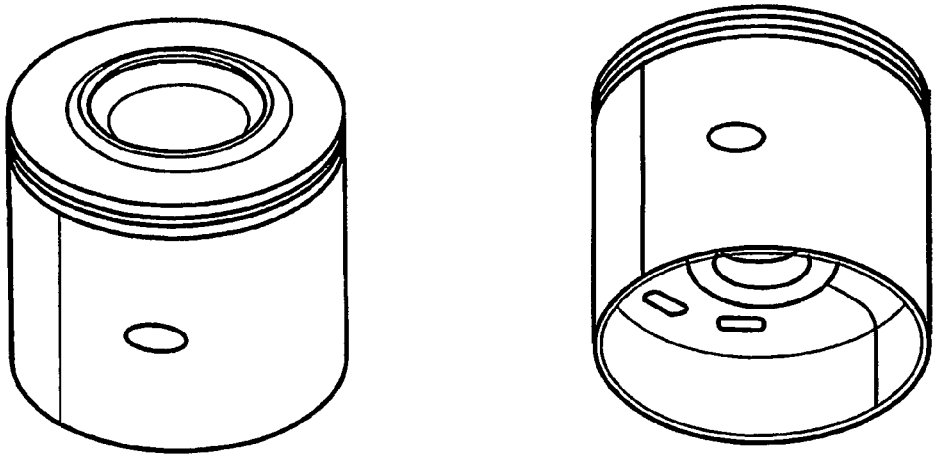
Figure 12A:
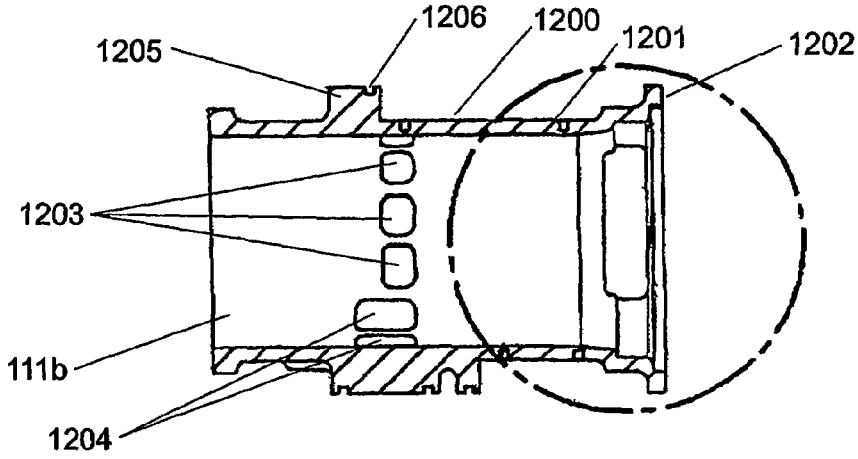
Figure 12B:
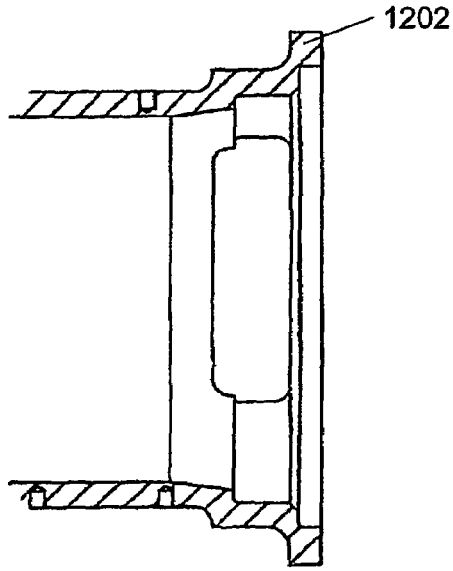
Figure 12C:
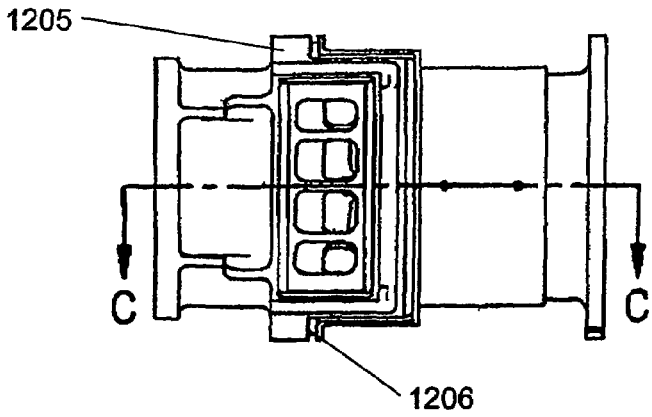
Figure 13A:
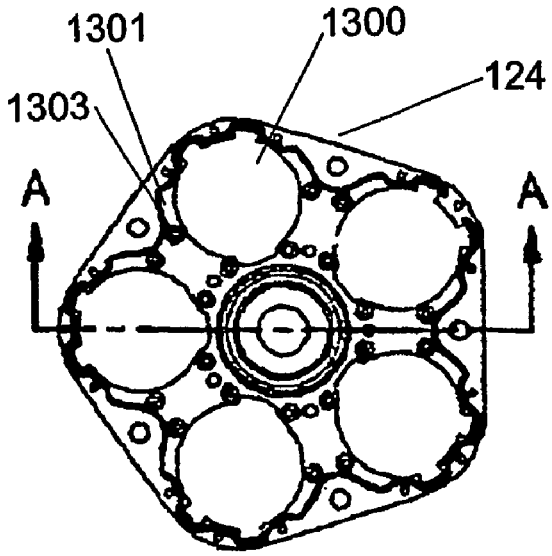
Figure 13B:
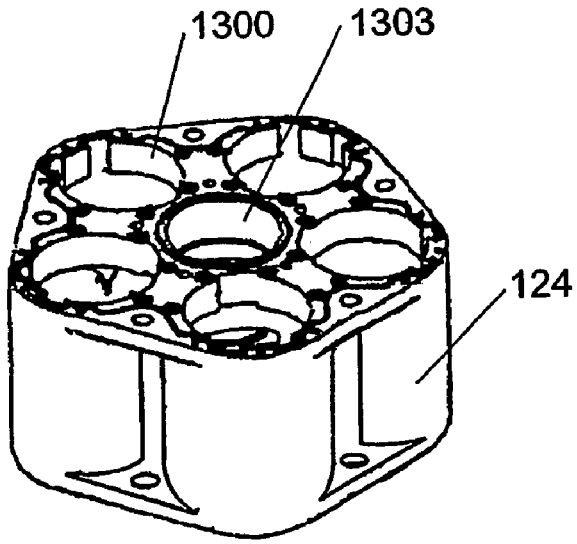
Figure 14:
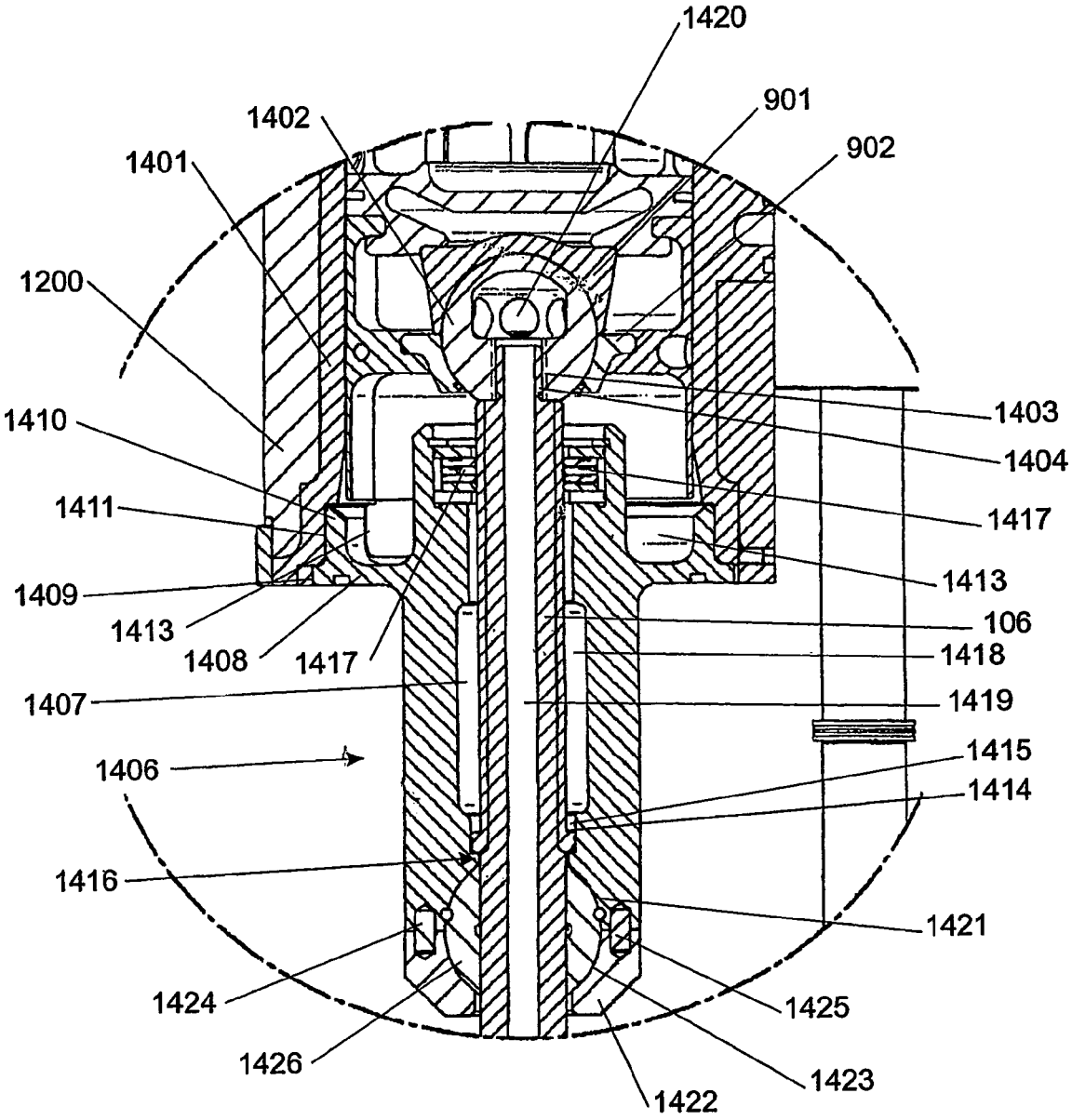
Figure 15:
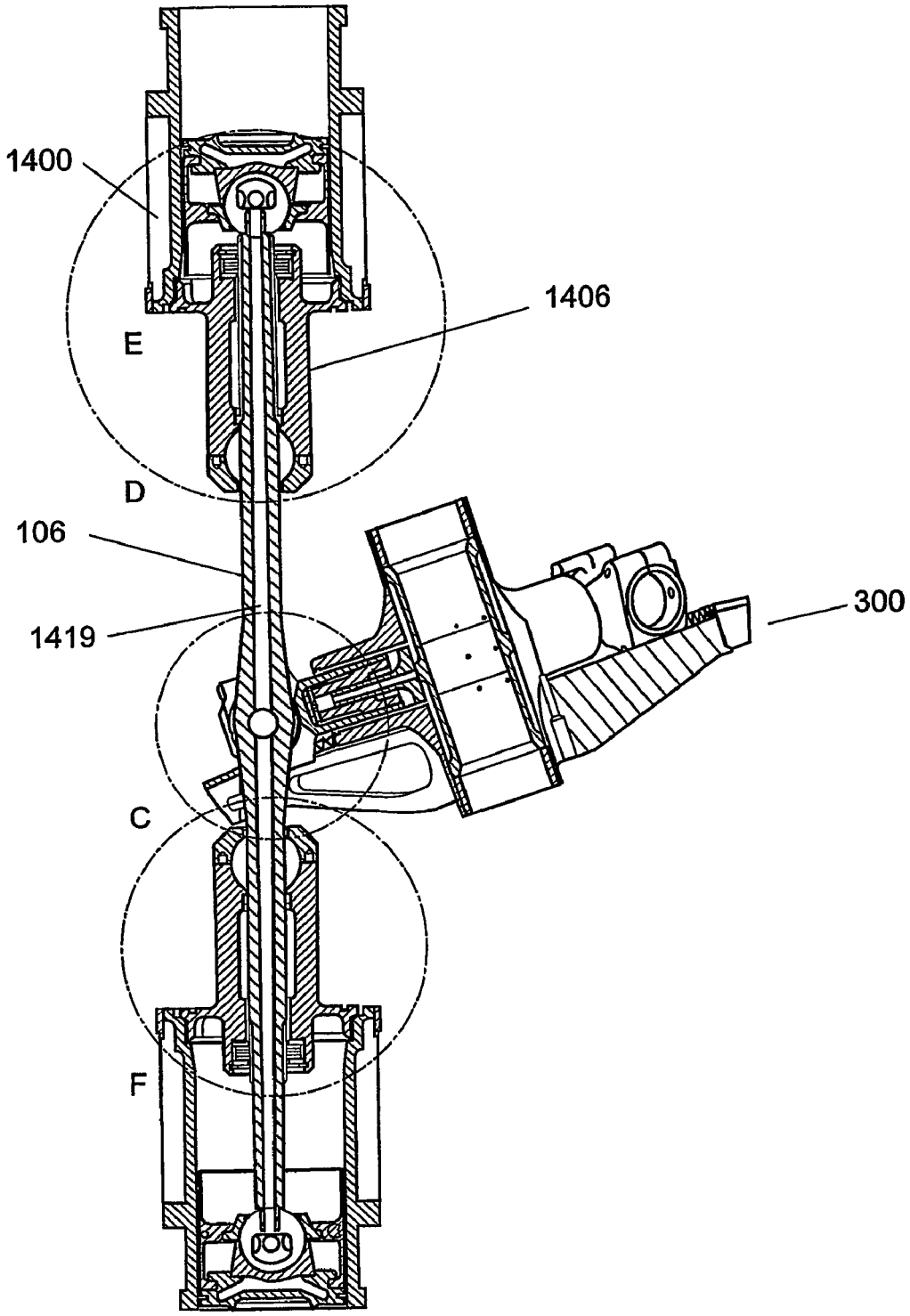
Figure 16:
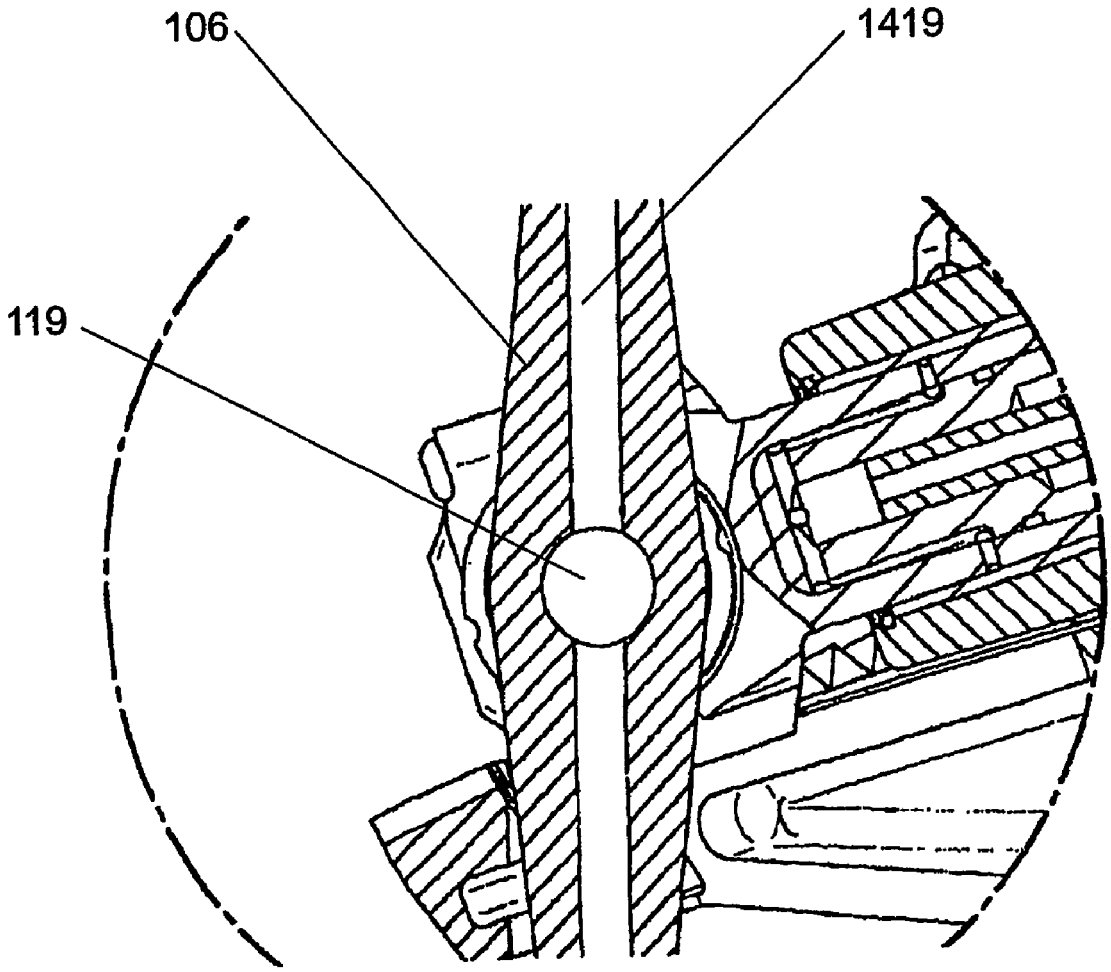

The invention will now be described with reference to the accompanying drawings of which:

FIGS. 1 and 2 show in plan, elevation, left/right side elevation and isometric views, a preferred embodiment of an axial motor with opposed pistons and a power transmission apparatus, FIGS. 3 and 4 show elevation, plan and perspective views of a coupling support, couplings and a lower gear restraint of the transmission apparatus, FIG. 5*a* is an elevation view of the power transmission apparatus (with upper gear restraint removed for clarity), z crank and output shaft, FIG. 5*b* is an elevation view of the power transmission apparatus, z crank and output shaft showing the upper and lower gear restraint FIG. 6 is an elevation cross-sectional view of the power transmission apparatus (with both gear restraints removed for clarity), z crank and output shaft shown in FIGS. 5*a* and 5*b*, FIG. 7*a* shows a pivot axle of a connecting rod installed in a knuckle joint with details of the power transmission apparatus removed for clarity, FIG. 7*b* shows a pivot axle of a connecting rod installed in a knuckle joint, FIG. 8*a* is a plan cross-sectional view (taken through C—C as shown in FIG. 3) of the power transmission apparatus showing telescopic arms (wobble sliders) of the coupling support, FIG. 8*b* is a cross sectional view of one wobble slider in further detail, FIG. 8*c* is a cross sectional view of one wobble slider showing bearing surfaces, FIGS. 8*d* to 8*g* are elevation views of a cut away portion of the coupling support showing, one wobble slider and the bearing surfaces, FIGS. 8*h* and 8*i* are plan views showing the bearing surfaces, FIG. 9 is an exploded isometric view of a carbon piston, FIGS. 10*a* and 10*b* are elevation and plan cross-sectional views (taken through A—A and B—B as shown in FIG. 12 respectively) of the assembled piston including a bearing, and a little end of a connecting rod, FIGS. 11*a* and 11*b* are plan, elevation and isometric views of the assembled piston, FIGS. 12*a*, 12*b* and 12*c* full and cross-sectional elevation views of a carbon liner for installation in a cylinder bore of the engine block, FIGS. 13*a* and 13*b* are elevation and isometric views of the engine block respectively showing detail of the cylinder bores and a turbo charger cavity, FIG. 14 is a cross-sectional view (taken through B—B as shown in FIG. 1) of the assembled piston, upper part of an oil pump and connecting rod, FIG. 15 is an elevation cross-sectional view (taken through B—B as shown in FIG. 1) of the axial motor, showing one set of opposed pistons and connecting rods coupled to a respective wobble slider, and FIG. 16 shows further detail of the coupling point in FIG. 15.

DETAILED DESCRIPTION OF THE PREFERRED EMBODIMENTS

Referring to the drawings it will be appreciated that an axial motor according to the invention, and a power transmission apparatus according to the invention for use in an axial motor, may be implemented in various forms. The following embodiments are given by way of example only.

FIGS. 1 and 2 show various views of a preferred embodiment of an axial internal combustion motor 100, including a preferred embodiment of a power transmission apparatus 300 for converting linear reciprocal motion of pistons 101*a*–105*b* into rotational motion of an output shaft 115*a*, 115*b*. The cylinder block 124 of the motor has been omitted from some of the views for clarity. The engine block 124 is described in detail with reference to FIGS. 13*a* and 13*b*. The invention will be described in relation to converting the reciprocal motion from an internal combustion cylinder/piston arrangement, however the power transmission device or apparatus 300 (wobble means) is not limited just to use with internal combustion engine applications. The invention can be adapted for converting any linear reciprocal motion power source or thrust means, a circular array of solenoid or hydraulic rams being other examples. The power transmission apparatus 300 is shown by itself in FIGS. 3 and 4 for clarity. The apparatus 300 includes coupling support 306 and a main coupling (also termed a z crank coupling) 117 for attachment to a z-crank 114, which in turn is attached between ends 115*a* and 115*b* of an output shaft. Reference to the power transmission apparatus 300 can include the coupling support 306/coupling 117 by itself only, or the entire coupling support 306/coupling 117, z crank 114 and/or output shaft arrangement 115*a*, 115*b*.

With reference to FIGS. 1 to 4, where like reference numerals refer to the same component in each view, the axial motor 100 includes a plurality of pistons 101*a*–105*b* with a corresponding connecting rod 106–110 extending between the base of each respective opposed piston pair. In a preferred embodiment there are 10 pistons 101*a*–105*b* arranged in five inline opposed pairs 101*a*, 101*b*; 102*a*, 102*b*; 103*a*, 103*b*; 104*a*, 104*b* and 105*a*, 105*b* disposed in a circular array about a central axis of the motor 100 each connected by a respective connecting rod 106–110. Each piston is housed in a corresponding cylinder in the cylinder block 124, of which cylinders 111*b*, 112*b*, 113*b* corresponding to pistons 101*b*, 102*b*, 103*b* are visible in FIG. 2. The cylinders and pistons are described in relation to FIGS. 9–13. The cylinder blocks can also include an internal turbo charger arrangement, such as that described in WO 00/11330.

The up and down motion of the pistons is transferred to the output shaft 115*a*, 115*b* by way of the power transmission apparatus 300 or wobble means. This motion is coupled from the connecting rods to the apparatus 300 by locating a pivot axle e.g. 700 (visible in FIGS. 7*a*, 7*b*) of each connecting rod 106–110 in a corresponding coupling 118–122, such as a knuckle joint, disposed on a corresponding telescopic arm or wobble slider 806 (not visible in FIGS. 7*a*, 7*b*) retained in a respective arm of the coupling support 306 of the apparatus 300 in a telescopic arrangement. Detail of the pivot axles e.g. 700 and knuckle joints 118–122 will be described with reference to FIGS. 7*b* and 7*b*. Detail of the wobble sliders 806 will be described with reference to FIGS. 8*a*–8*i*. Each axle, e.g. 700, can pivot in a corresponding knuckle joint e.g. 188 to allow the corresponding connecting rod to remain in a substantially vertical orientation throughout the reciprocating stroke cycle of the respective piston.

The coupling support 306, which is more clearly visible in FIGS. 3 and 4, extends radially outwardly from the main shaft coupling 117 of the power transmission device to provide a means to hold respective wobble sliders with knuckle joints 118–122 in a substantially circular arrangement about a longitudinal axis of the main shaft coupling 117. Preferably the coupling support 306 comprises five arms 301–305 integrally formed with the main shaft coupling 117 and extending radially. It will be appreciated however that the coupling support 306 is not restricted to radially extending arms and could comprise, for example, a plate or annular ring attached to the main shaft coupling 117 which receives wobble sliders. In this way the reciprocal motion of the pistons can be transferred to the main shaft coupling 117 which in combination with the z crank 114 rotates the output shaft 115*a*, 115*b* in a manner to be described later. The transmission apparatus 300 also includes a lower gear restraint 307 comprising an annular ring which supports a plurality of teeth. The lower restraint 307 surrounds the main shaft coupling 117 and is attached by way of a plurality of support arms 308–312 which are integrally formed with the main shaft coupling 117 and are bolted, or otherwise attached to, or integrally formed with the annular gear restraint 307 as can be seen in FIG. 4. The teeth are adapted to mesh with a corresponding upper gear restraint 500 (visible in FIG. 5*b*), which is anchored to a support structure, such as a motor chassis, and remains stationary, independent from the movement of the power transmission apparatus 300. The coupling support 306, wobble sliders 806, couplings 118–122, and connecting rods 106–110 do not extend radially beyond the annular gear restraints 500, 307, but rather remain inside the annular boundary.

Referring to FIGS. 5*a*, 5*b* and 6, the main shaft coupling 117 of the transmission apparatus 300 is adapted to be rotatably mounted or coupled on a crankshaft 616 of the z crank 114. Preferably the main shaft coupling 117 is integrally formed as, or includes a coupling sleeve for the crankshaft 616. Alternatively the main shaft coupling includes another type of suitable coupling which is adapted for attachment on the crankshaft 616. The z crank 114 has two crank pin webs 116*a*, 116*b* rotatably mounted at each distal end of the crankshaft 616. Each crank pin web 116*a*, 116*b* is adapted to rotatably connect to a respective end of the output shaft 115*a*, 115*b* at an angle such that the transmission apparatus 300 and crankshaft 616 lie inclined at an angle with respect to the longitudinal axis of the output shaft 115*a*, 115*b* (as shown in FIG. 1). The preferred angle is between 17° and 18° from the vertical, with a perpendicularly preferred angle of substantially 17.5°, although it will be appreciated by somebody skilled in the art that the inclination can fall within a greater range of angles.

FIG. 5*b* shows detail of the lower gear restraint 307 on the transmission apparatus 300 which meshes with a corresponding annular upper gear restraint 500 attached to a support structure such as the motor chassis. The upper gear restraint 500 is omitted from FIG. 5*a* to show obscured detail. The respective gear restraints 500, 307 mesh at the point 502 at which one of the upper pistons is at the top of its stroke. During operation of the motor 100, the cycle for each pair of opposed pistons 101*a*, 101*b*; 102*a*, 102*b*; 103*a*, 103*b*; 104*a*, 104*b* and 105*a*, 105*b* is staggered such that the top dead centres (TDCs) for the upper pistons 101*a*–105*a* occur sequentially in a circular manner. For example, the TDCs may occur clockwise viewed from above as shown by the arrow 130 in FIGS. 1, 5*a*, 5*b*, although it could occur counterclockwise. This sequential piston movement wobbles the power transmission apparatus 300 and lower gear restraint 307 such that the mesh point 502 of the gear restraints 500, 307 moves in a corresponding circular manner (shown by arrow 130 in FIG. 1) about the central axis of the motor 100. The gear restraint mechanism 500, 307 prevents or limits the main shaft 117 of the transmission apparatus 300 and the z crank from spinning around crankshaft 616 of the z crank 114. It can be seen from the elevation view in FIGS. 5*a*, 5*b*, that the plane 503 on which each of the couplings or big ends fall, intersects with the extension line (bisector) of the gear restraints' 500, 307 mesh point 502, the rotational axis of the output shaft 504 and the longitudinal axis 506 of the crankshaft 616 at a deadpoint 501 within the coupling shaft 117. This arrangement limits lateral movement in joints of the motor arrangement.

The annular gear restraints 307, 500 have a diameter large enough such that the connecting rods 106–110 operate within the annular gear restraints. This larger diameter enables more teeth to be provided on the gear restraints 307, 500 than if the connecting rods operated outside the restraint mechanism. The increased number of teeth reduces the individual loading on each tooth due to the thrust of the pistons. Reducing the per tooth thrust is particularly advantageous in the case where opposed pistons are used, as the thrust is double that of a similar motor using non-opposed pistons. This enables a lighter composite material to be used for the gear restraints 307, 500, rather than a heavier metallic construction, which would usually be required to cope with the increased thrust generated in an opposed piston motor. The larger diameter upper gear restraint 500 also enables the restraint to be securely fixed to the support structure.

The structure of the z crank 114 will be described in detail with reference to FIG. 6, which shows a cross sectional view through the longitudinal axis of the transmission apparatus 300 shown in FIGS. 5*a*, 5*b*, An upper sleeve 608 slides over a cylindrical protrusion 600 on the upper crank pin web 116*a*. The protrusion 600 includes a threaded blind bore 609 for attachment to the upper output shaft 115*a* (not shown) by way of a bolt or the like. The web 116*a* also includes a semi cylindrical body 601 with a hollowed portion corresponding to a protruding end of the crankshaft 616. The hollowed portion is installed on the crankshaft and then clamped in place by way of two flanges 602 (one of which is visible) which are bolted together. Another bolt is inserted through aligned bores 607 in the web 116*a* and the crankshaft 616 to prevent the web 116*a* spinning around the crankshaft 114. The semi-cylindrical body 601 includes a recessed portion 610 which enables the web 116*a* to rotate with the crankshaft about the exterior of the coupling or coupling sleeve 117. The crankshaft 616 extends through the coupling sleeve and protrudes from either end. It rotates on bearings 604 disposed within an inner surface of the coupling sleeve 117.

The crankshaft 616 includes a larger diameter bore 605 that tapers into a smaller diameter bore 606. The lower crank pin web 116*b* includes a semi-cylindrical body 615 and a protrusion 612 with a sleeve 613. The protrusion 612 includes a blind threaded bore 614 for attachment to the lower portion of the output shaft 115*b* (not shown in FIG. 6) by way of a bolt, or the like. The web 116*b* includes a hollow portion 620 that is mounted on the crankshaft 616. Also visible in FIG. 6 is an internal structure of one of the telescopic wobble arms eg 806 that will be described in detail with reference to FIGS. 8*a* and 8*b*.

FIGS. 7*a* and 7*b* show the manner in which the pivot axle eg 700 of each connecting rod 106–110 engages with a respective knuckle joint 118–122. The pivot axle/knuckle joint arrangement will be described with reference to connecting rod 106 corresponding to pistons 101*a*, 101*b* by way of example. This description also relates to the other piston/axle/connecting rod arrangements. The pivot axle 700 is located halfway along the connecting rod 106 and comprises two oppositely arranged cylindrical protrusions 705, 706. Each protrusion 705, 706 is integrally formed with and extends substantially horizontally from the connecting rod 106. The corresponding knuckle joint 118 comprises a substantially u-shaped bearing cradle comprising a base 701, curved inner face 709 (visible in FIG. 5) and two pairs of protrusions 702*a*, 702*b* and 703*a* (703*b* is not visible). The protrusions 705, 706 of the axle 700 are located in the bearing cradle. A corresponding pair of cradle clamps 704 (one clamp being omitted from FIGS. 7*a*, 7*b* for clarity) with a semicircular internal bearing face 708 is bolted to each respective cradle protrusion pair (for example, 703*a*, 703*b* in FIGS. 7*a*, 7*b*) to retain the pivot axle 700 in position. The axle 700 is then free to pivot within the assembled joint 118 on the internal bearing faces 704, 708 of the bearing cradles and clamps respectively. Each knuckle joint 118 is connected to a respective telescopic arm 806 (also called a wobble slider) which reciprocates within a respective arm 301 of the coupling support 306. The wobble sliders enable slidable coupling of the connecting rods 106–110 to the z crank.

FIG. 8*a* shows detail of the internal portions of radial arms 301–305 that form the coupling support 306. Each arm 301–305 comprises a base portion that receives a telescopic extension arm portion, or wobble slider, that slides within the base portion. The wobble sliders form reciprocating couplings for connection to the connecting rods 106–110. FIGS. 8*b* and 8*c* show one of the arms in further detail, wherein bearing surfaces 820 and 821 have been omitted from FIG. 8*b* for clarity. The slider mechanism will be described in relation to arm 301 however it will be appreciated that this description relates to each of the remaining arms 302–305. The base portion 800 includes an outer cylinder 801 that is preferably integrally formed with the main shaft 117 of the transmission apparatus 300. A pump piston 802 with an internal cylinder 803 extends through the interior of the outer cylinder 801 to provide an annular interior within the base portion 800. An O-ring 816 is embedded in the base of the pump. A bearing means 805, and sleeve 804 are disposed on the inner surface of the outer cylinder 801. The telescopic extension arm 806, or wobble slider, includes an integrated knuckle joint 119 and elongated body 808 with a cylindrical outer surface.

The diameter of the body 808 is dimensioned to fit within the outer cylinder 801 and sleeve 804 and bearing 805. The body has an inner sleeve 809 that includes a cylindrical bore 810 dimensioned to receive the pump piston 802. The wobble slider 806 is housed in the base portion 800 such that the outer surface of the body 808 comes into contact with the bearing means 805 and sleeve 804 and the piston 802 resides in the cylindrical bore 810. The wobble slider 806 is able to slide relative to the base portion 800. During operation of the motor the wobble means 300 wobbles in a manner such that the radial distance between the centre of the wobble means 300 and the position of the pivot axle 700 on the connecting rod varies between a minimum and maximum displacement. The wobble slider 806 extends from and retracts into the base portion 800 to compensate for the radial displacement to enable the connecting rod to remain in a substantially vertical orientation (when the motor is supported in a vertical orientation). It will be appreciated therefore, that in the general case, the wobble slider 806 allows the connecting rod to remain in a substantially aligned or coincident relationship with an axis 131 (visible in FIG. 1) extending between the opposed pistons 101*a*, 101*b* of the pair.

Referring to FIG. 8*c*, the reciprocating motion of the wobble slider 806 takes place on two annular bearing surfaces, the first 821 at the base of the wobble slider 806, and the second 820 on the internal base of the outer cylinder 801. The bearing surfaces will be described in more detail with respect to FIGS. 8*d* to 8*i*. FIGS. 8*d* and 8*f* show a cut away portion of one arm of the coupling support revealing detail of the wobble slider and surface bearings. FIGS. 8*e* and 8*g* are close ups showing more detail, while FIGS. 8*h* and 8*i* show plan views of the two bearing surfaces 820, 827. It should be noted that the bearing surfaces shown in these Figures are not to scale, but rather are shown oversized to illustrate detail. The ramp peaks referred to are approximately ⅛ inches high in the preferred embodiment.

Referring to FIGS. 8*d*, 8*e*, 8*f*, 8*g* and 8*i* the second bearing surface 820 comprises two wave-formed annular ramps 823, 824 disposed diametrically opposite on the internal base of the outer cylinder 801, and interspersed between flat annular surfaces 825, 826. Referring to FIGS. 8*d*, 8*e*, 8*f*, 8*g* and 8*n* the first bearing surface 810 comprises two wave-formed annular ramps 827, 828 disposed diametrically opposite on the base of the wobble slider 806. The ramps 827, 828 are interspersed between annular flat plateau portions 829, 830 and annular troughs 831, 832, 833, 834.

Referring now to FIGS. 8*f* and 8*g*, during the portion of the cycle where the wobble slider 806 is horizontal (corresponding to a point where the opposed pistons 101*a*, 101*b* coupled to connecting rod 106 have travelled halfway through their respective cylinders), the wobble slider is retracted entirely into the outer cylinder 801. The ramps 827, 828 of the first bearing surface 821 sit in the knee at the base of ramps 823, 824 of the second bearing surface 820. Similarly, the ramps 823, 824 reside within the complementary troughs 832, 834. The annular plateaus 829, 830 also bear against the annular flat surfaces 825, 826 of the second bearing surface 821 in a sliding fit As the pistons continue their travelling, urging the connecting rod 106 upwards as shown by arrow 835*a* (visible in FIG. 8*f*), the wobble slider 806 rotates slightly as shown by arrow 836 (visible in FIG. 8*g*).

During rotation, the ramps 827, 828 slide up opposing faces 836, 837 of second bearing ramps 823, 824, until they reach the peak of ramps 823, 824 as shown in FIGS. 8*d*, 8*e*. This corresponds to the maximum upward travel of the connecting rod. During this movement, the wobble slider 806 extends out of the outer cylinder 801 retaining the connecting rod 106 in a substantially vertical orientation. As the connecting rod 106 reverses its movement downward 835*b*, the wobble slider 806 continues rotating so that the ramps 827, 828 slide down corresponding reverse faces 838, 839 of ramps 824, 825 until the connecting rod 106 reaches the centre point of its travel again. During this movement, the wobble slider 806 retracts back into the outer cylinder 801 to retain the connecting rod 106 in a substantially vertical orientation. At the maximum extent of this retraction (corresponding to the centre point of travel of the connecting rod) bearing surfaces 820, 821 are in a similar state to that shown in FIGS. 8*f*, 8*g*, except that ramps 827, 828 reside in the opposite knee at the base of ramps 823, 824. Also, the plateaus 829, 830 bear on surfaces 825, 826 and ramps 823, 824 reside in the other troughs 831, 833. This explanation is one half of the wobble slider movement corresponding to a half cycle of connecting rod movement. The connecting rod will continue its downward movement, and then reverse to return to the central position. The bearing surface 820, 821 motion is the same as the first half of the cycle described, except that it takes place in the opposite rotational direction, as shown by arrow 840.

During the reciprocating motion of the wobble slider 806, the piston 802 arrangement is damped by hydraulic fluid, for example damping oil. Referring back to FIGS. 8*a*, 8*b* the inner cylinder 803 of the piston 802 is in fluid communication with hydraulic fluid in the z crank 114 through opening 851. As the wobble slider 806 retracts into the base portion 800, hydraulic fluid that resides in the cylinder 803 is compressed in the upper part of the cylindrical bore 810 to provide a damping function. Further, during compression, the hydraulic fluid is expelled, as shown by the arrows, via channels 811, 812 formed in the inner sleeve 809. The fluid exits the channels via openings 813, 814 into the interior of the base portion 800 to lubricate the sleeve 804 and bearing 805. During compression, the fluid is also expelled via another channel 815 into the knuckle joint to provide lubrication. Any residual lubrication between the sleeve 804 that enters the cavity 817 at the base of the wobble slider 806, is expelled into the z crank 114 via outlets 818, 819 during retracting of the slider 806.

The damping fluid from the z crank 114 enters the respective wobble sliders in coupling support arms 301–305, through openings 851–855 (all visible in FIG. 8*a*). As the wobbling action of the coupling support 306 takes place, the openings 851–855 each move in and out of alignment with a corresponding bore. For example as shown in FIG. 8*b*, opening 851 in the z crank, aligns with inner cylinder 803 to allow damping fluid to flow into the wobble slider 806. The opening 851 is in alignment with cylinder 803 when the wobble slider is at its full extension. As the slider 806 retracts, the z crank 114 moves laterally due to the general action of apparatus. At the point of complete retraction, the opening 851 is completely out of alignment with cylinder 803, so that no damping fluid flows back into opening 851.

Operation of the power transmission apparatus in relation to an axial internal combustion motor arrangement will now be described with reference to FIGS. 1 to 8*i*. It will be appreciated that details of the general function of a z crank 114 will be known to those skilled in the art and therefore no detailed description of this function will be provided. It should also be appreciated that the generally described operation could also apply to any reciprocal power source other than internal combustion cylinder/piston arrangements. The five axially arranged piston/cylinder pairs power sources are configured to fire a combustible charge sequentially in either a clockwise or anticlockwise manner. In two stroke and four stroke operation the top dead centre of each upper piston/cylinder arrangement of an opposing piston pair will coincide with the bottom dead centre of the corresponding lower piston/cylinder arrangement. As each opposed piston pair imparts either an upward or downward thrust, this is transferred to the z crank 114 via the corresponding knuckle joint wobble slider and radial arm coupling support 306.

By virtue of the sequential firing of the cylinders, the forces from each piston pair are imparted in a sequential circular manner. This causes the z crank 114 to wobble about the intersection deadpoint X 501 in an inclined circular manner with each distal end of the coupling sleeve 117 rotating in a circular motion. The circular motion traced out by each end of the sleeve 117 is transferred to the output shaft portions 115*a* and 115*b* respectively via the crank pin webs 116*a* and 116*b*. This motion also produces a wobbling action in the coupling support 306 and lower gear restraint 307. The wobble slider 806 in each arm of the coupling support 306 extends and retracts as the coupling support oscillates in a substantially vertical manner at the point of coupling with each respective connecting rod. This retains the connecting rods in alignment with the pistons. The lower gear restraint 307 meshes with the upper gear restraint 500, the mesh point 502 moving in an annular fashion about the gear restraints in accord with the strokes of each piston. In this manner the gear restraint mechanism enables the z crank 114 to rotate in the desired manner, while still substantially preventing the transmission apparatus spinning about the longitudinal axis of the z crank 114 and sleeve 117. It will be appreciated that the power transmission apparatus could be adapted for use with any other suitable number of axially arranged pistons, either opposed or otherwise.

FIG. 9 shows an exploded isometric of a preferred embodiment of a modular piston, which can be used in an axial motor, each of the components being manufactured from carbon composites. The piston includes a piston head or crown 900 seated on a little end bearing formed from an upper socket 901 and a lower socket 902. The crown 900 and bearing assembly is seated or otherwise retained in a piston skirt housing formed from two semi-cylindrical halves 903*a*, 903*b* which are joined by way of bolts or the like. The piston crown 900 is of generally cylindrical construction with a hollowed interior 1002 the hollow reducing heat transfer to the surroundings. Details of the interior 1002 and underside of the crown 900 are visible in the cross-sectional view shown in FIG. 11. The crown 900 has a circular recess 904 in the top surface to provide a swirling motion to assist fuel/air mixing. The crown 900 also includes upper 905 and lower 906 annular recesses in the outer surface. The crown 900 further includes an annular rim 1003 on the bottom edge with an annular recess 1004 dimensioned for engaging the upper surface edge of the upper bearing socket 901. The upper socket 901 has a generally tapered cylindrical outer surface 907, with a partially spherical protrusion 908 on the upper surface which corresponds with the hollow interior 1002 of the crown 900. The internal portion of the upper socket 901 is a substantially hemispherical hollow to match the spherical nature of a top portion of a little end of a connecting rod. The lower socket 902 of the bearing means comprises a frustohemispherical socket 909, that is a hemispherical socket in which the apex has been removed to leave a base portion with an opening in the top. A flange 910 extends from the base edge of the socket 909. A bottom annular edge 1001 of the upper socket 901 rests on the flange 910 of the lower socket 902, the matching inner hemispherical portions of each socket forming a spherical socket for a bearing at the little end of the connecting rod.

Each half of the outer skirt 903*a*, 903*b* includes a semi-annular lip on the top edge 915*a*, 915*b* and an internal semi-annular shelf 912*a*, 912*b* with a profiled top surface. When both halves 903*a*, 903*b* of the outer skirt are coupled together each semi-annular lip 915*a*, 915*b* form an annular lip for engaging in the lower annular recess 906 in the crown 900. Further the shelves 912*a*, 912*b* form an annular shelf adapted for seating the flange 910 of the lower socket 902 and the annular rim 1001 of the upper socket 901. More particularly, the profiled shelf includes a recess 913 with a ledge and side adapted for seating the flange 910 such that the lower socket 902 is retained by the skirt in an upside down manner in which the frustohemispherical portion protrudes downwardly through the annular shelf 912*a*, 912*b*. The profiled shelf also includes a bevelled 914 edge about the recess 913. In this manner the upper 901 and lower 902 bearing sockets are retained within the skirt 903*a*, 903*b* in an aligned fashion to form the spherical little end socket. Bolt holes 1101 and 1102 (more easily visible in FIG. 11) a bored through one half 903*b* of the outer skirt, and corresponding threaded blind holes are bored into the other half 903*a* of the skirt to enable the skirts 903*a*, 903*b* to be fastened together by way of bolts or other suitable fastening means. The profiled shelf 912*a*, 912*b* also includes a plurality of recesses, eg 916, for weight reduction purposes. The lower half of each skirt 903*a*, 903*b* which extend below the profiled shelf form a lower cavity 917 of the piston.

FIGS. 10*a* and 10*b* show elevation and plan cross-sectional views respectively of the assembled carbon piston. The crown 900 is seated on the upper bearing socket 901 such that the annular recess 1004 in the annular rim 1003 of the underside of the crown is seated on an annular portion 1005 of the top surface of the upper socket 901. The lower annular rim 1001 of the upper socket 901 is seated on the flange 910 of the lower socket 902 to form the spherical bearing socket 1006. The outer skirt halves 903*a*, 903*b* are then clamped around the crown 900 and socket 901, 902 assembly. In this arrangement the flange 910 is seated in an upside down manner on the annular recess ledge 913, the lower surface of the upper socket 901 sits on the flange 910 and the annular lip 915*a*, 915*b* engages in the annular recess 906 in the crown 900 thus retaining all components of the piston in a secure manner. The two skirt halves 903*a*, 903*b* are clamped or otherwise fastened together by way of bolts or the like. The outside of the assembled piston is visible in FIGS. 11*a* and 11*b*.

FIGS. 12*a*, 12*b* and 12*c* show various views of a carbon composite liner 1200 for insertion into the engine block 124, shown in FIGS. 13*a* and 13*b*. The carbon liner 1200 provides a cylinder eg 111*b* in which a respective piston eg 101*b* reciprocates. The liner 1200 has an outer profile 1201 including an annular flange 1202 which sits in a surface recess eg 1301 at the entrance to a corresponding cylinder bore eg 1300 in the block 124. The liner 1200 can be secured in the bore 1300 by fastening the annular flange 1202 (shown in more detail in FIG. 12*b*) in the recess by way of bolts or the like which screw into respective openings eg 1303, positioned around the bore 1300. The liner 1200 includes various transfer ports 1203 and exhaust ports 1204 that communicate with ducting in the block 124 (not visible) for inlet of combustion fuel/gases and outlet of exhaust gases. Details of this will be known to those skilled in the art, and openings relevant to an internal turbo charger (if used) are described in WO 00/11330. The block 124 may also include the required cavity 1303 and ducting for an internal turbo charger. An annular flange 1205 on the outer profile includes a machined groove 1206 for an O-ring.

FIG. 14 shows the piston, cylinder and connecting rod assembly, with FIG. 15 showing detail of the full arrangement including wobble means, while FIG. 16 shows detail of the connecting rod/knuckle joint coupling. Referring to FIG.

14, the assembled piston resides in the cylinder liner that comprises an outer body 1400 and inner carbon liner sleeve 1200 that is adapted for a sliding fit with the piston. A bearing 1402 is installed in the bearing socket 1006 with a lower portion of the bearing 1402 protruding through the opening in the lower bearing socket 902. The protruding portion includes a blind bore 1403 for receiving the little end 1404 of a connecting rod 106. The diameter of the little end 1404 is smaller than that of the connecting rod 106 itself and is dimensioned to engage in the blind bore 1403. During operation the wobble slider arrangement also reduces the amount by which the connecting rod circulates, which happens in existing arrangements. This in turn can reduce movement of the bearing 1402, leading to reduced friction. This can reduce the need for lubrication of the bearing 1402 in the socket 902, especially if carbon components are used.

The connecting rod 106 extends through a central bore 1416 of a bearing support and pump cylinder 1406 that houses an upper portion of the connecting rod 106. The pump cylinder has an elongated cylindrical outer body with a first diameter 1407 which extends through a cylindrical head portion 1408 with a larger second diameter. The head portion 1408 is adapted to engage in a sealed manner with the bottom of the cylinder outer body 1400 and inner sleeve to form the cylinder enclosure. More particularly the head portion 1408 includes an exterior annular shelf 1409 with an annular wall 1410 that engage with a corresponding annular profile 1411 in the inner sleeve. A top end 1412 of the wall 1410 has a width which extends beyond the width of the inner sleeve to provide a shelf which provides a lower limit for movement of the piston. An annular interior 1413 is formed between the wall 1410 and top end of the elongated body 1407 of the pump cylinder 1406. The interior 1413 in combination with the lower piston cavity 917 form an enclosed cavity.

The upper end of the connecting rod includes an outer sleeve with an annular splayed end which forms a connecting rod pump piston 1414. A bush 1415 sits on the splayed end. An annular channel 1418 is formed in central bore 1416 of the connecting rod pump cylinder 1406 for the passage of oil or other suitable lubricating fluid in the connecting rod/bore interface to the piston cavity, if required. As the connecting rod moves linearly upwards and downwards within the central bore 1416 the splayed end of the pump piston 1404 and bush 1415 force hydraulic fluid through the channel 1418 and into the cavity and back again. This action provides lubricating fluid to both the connecting rod/bore interface and the piston/cylinder interface. It will be appreciated that this lubrication may not be required, or wanted, for example where a carbon piston is used. In this case, seals 1417, prevent lubrication on the connecting rod from the crankcase entering the cylinder cavity. Further, this seals exhaust gases from the crank case. The connecting rod also includes a central bore 1419 which provides a channel for transfer of lubricating fluid between the knuckle joint and the little end bearing 1402/bearing socket 1006 interface, if it is required. As the wobble slider action provides lubricating fluid into the knuckle joint, this is also transferred to the connecting rod bore 1419. The lubricating fluid flows through the bore into the little end bearing and into the bearing/bearing socket interface via openings 1420 in the bearing 1402. It will be appreciated that this lubrication is not required if carbon pistons are used. The lower end of the elongated pump cylinder 1402 has a hemispherical recess 1421 in its bottom face. A pump piston cover 1422 with a corresponding hemispherical recess 1423 is attached to the pump piston by couplings 1424, 1425 to form a spherical bearing socket for a connecting rod bearing 1426. The connecting rod bronze bearing or bush 1426 takes any residual side thrust, and also assists sealing of the piston/cylinder from the crankcase. This assists in preventing lubrication fluid going into the piston/cylinder if this is not desired, and also assists in preventing combustion gases entering the crankcase. It also prevents the piston going into the crankcase.

Keeping the connecting rods substantially vertical (assuming the motor is supported vertically) during operation by way of the wobble slider mechanism, reduces side loading on the pistons. This enables a carbon piston and carbon liner cylinder (or other non-metallic composite) to be used in the axial motor instead of the traditional metallic pistons and cylinders. Composite components are generally not strong enough to be used in existing motors where the side thrust is much greater. While it is not essential to use composite piston/cylinder components in the invention, use of them provides several benefits. First of all the composites are lighter, making for an overall lighter motor. Secondly, the composite components do not expand and contract as much due to heat. This, coupled with the reduced side thrust, enables the composite cylinder/piston components to be manufactured to a closer working tolerance than if metallic components are used. As a result piston rings are not necessary, and this coupled with the nature of composite materials, means that lubricant in the piston/cylinder is not necessary. It is envisaged that this will reduce the emissions from the engine. In such a case where composite piston/cylinders are used, each connecting rod bearing and seal, e.g. 1426, 1417, seals the respective piston/cylinder from the z crankcase to prevent lubricant entering the piston/cylinder, and to prevent exhaust gases entering the crankcase. Without the seals (1417 being the main seal, with bearing 1426 providing some assistance sealing), lubricant on the connecting rods could enter the respective cylinders. The seals are possible by virtue of the connecting rods being retained in a substantially vertical orientation during operation (or in the general case, in-line with the axis through the pistons). Existing engines have circulating connecting rods that are far more difficult to seal under operating conditions. Further, the seal/bearing 1426 bears any residual side thrust from the respective connecting rod, further reducing any side thrust experienced by the piston/cylinder arrangement. Again, bearing the load of the connecting rods in this way would be difficult if they are not kept substantially in-line with the pistons during operation.

The invention claimed is:

1. An axial motor comprising:

a plurality of reciprocating thrust means arranged as opposed pairs in a substantially circular array about a central axis;

a connecting rod for each thrust means pair connecting the thrust means in that pair, each connecting rod coincident with an axis extending through the respective thrust means pair it connects;

a z crank coupled between the ends of an output shaft extending substantially coincident with the central axis, and comprising a crankshaft; and a power transmission apparatus comprising a z crank coupling coupled to the crankshaft of the z crank, a plurality of coupling support portions which are fixed relative to the z crank coupling, and a plurality of reciprocating coupling sliders, each engaged with a respective coupling support portion, wherein each coupling slider extends outwardly from the respective coupling support portion in a direction substantially transverse to the crankshaft and is reciprocable relative to the coupling support portion by means of a telescopic coupling and is connected to a corresponding connecting rod, wherein each coupling slider is adapted to transfer thrust from a corresponding thrust means pair to the z crank while reducing side thrust on the thrust means pair, by reciprocation relative to the respective coupling support portion in a direction substantially transverse to the crankshaft, with each coupling slider reciprocating relative to the respective coupling support portion by means of a sliding extending and retracting movement to compensate for movement in the transmission apparatus to retain each corresponding connecting rod substantially aligned with the axis extending through the respective thrust means pair it connects.

2. An axial motor according to claim 1 wherein each thrust means is a piston adapted to reciprocate in a respective cylinder in an engine block.

3. An axial motor according to claim 2 wherein the pistons are arranged as in-line opposed pairs.

4. An axial motor according to claim 3 wherein the pistons are constructed from non-metallic composite, and each reciprocates in a corresponding cylinder constructed from a non-metallic composite.

5. An axial motor according to claim 4 wherein the non-metallic composite is a carbon composite, and the cylinders comprise a carbon composite liner disposed in an engine block of the axial motor.

6. An axial motor according to claim 5 wherein seals and bearings are disposed adjacent the connecting rods to isolate the respective pistons and cylinders from lubrication fluid, and at least partially bear residual side thrust on the connecting rods to reduce side thrust on the pistons.

7. An axial motor according to claim 6 wherein the transmission apparatus comprises:

a z crank coupling, and a plurality of coupling support arms extending radially from the z crank coupling in which the coupling sliders can oscillate.

8. An axial motor according to claim 7 wherein the reciprocating coupling sliders pump damping and lubricating fluid.

9. An axial motor according to claim 1 wherein each connecting rod is connected to a respective coupling slider by a knuckle joint.

10. An axial motor according to claim 1 further comprising a restraint mechanism to prevent the transmission apparatus spinning around the axis of the z crank.

11. An axial motor according to claim 10 wherein the restraint mechanism comprises an upper annular gear restraint secured to a support structure, and a lower annular gear restraint coupled to the transmission apparatus, and wherein the connecting rods operate within the upper and lower annular gear restraints.

12. An axial motor according to claim 11 wherein the upper and lower gear restraints are constructed from a non-metallic composite material.

13. An axial motor according to claim 12 wherein each connecting rod is connected to a respective coupling slider by a knuckle joint and wherein the upper and lower annular gear restraints engage at a mesh point and the plane on which the knuckle joints reside, intersects at a point with an extension line of the gear restraints' mesh point, rotational axis of the output shaft and longitudinal axis of the z crank.

14. An axial motor according to claim 1 wherein the reciprocating coupling sliders retain the connecting rods in a substantially vertical orientation when the motor is supported in a substantially vertical orientation.

15. A power transmission apparatus adapted for transferring thrust from reciprocating thrust means arranged axially in opposed pairs to a z crank of an axial motor, with each pair of opposed thrust means being connected by a respective connecting rod which extends between the opposed thrust means, the apparatus comprising:

a z crank coupling for connecting the transmission apparatus to a crankshaft of a z crank;

a plurality of coupling support portions which are fixed relative to the z crank coupling;

a plurality of reciprocating coupling sliders, each engaged with a respective coupling support portion, wherein each coupling slider extends outwardly from the respective coupling support portion in a direction substantially transverse to the z crank coupling and is reciprocable relative to the coupling support portion by means of a telescopic coupling and is configured for connection to a respective connecting rod;

wherein upon installation of the apparatus in an axial motor, each coupling slider is connected to a respective connecting rod, and during operation of the motor, each coupling slider is adapted to transfer thrust from a corresponding thrust means pair to the z crank while reducing side thrust on the thrust means pair, by reciprocating relative to the respective coupling support portion in a direction substantially transverse to the z crank coupling, with each coupling slider reciprocating relative to the respective coupling support portion by means of a sliding extending and retracting movement to compensate for movement in the apparatus to retain each connecting rod substantially aligned with an axis extending through the respective thrust means pair it connects.

16. An apparatus according to claim 15 wherein the coupling support portions comprise a plurality of coupling support arms extending radially from the z crank coupling and in which the coupling sliders can oscillate.

17. An apparatus according to claim 16 wherein the reciprocating coupling sliders pump damping and lubricating fluid.

18. An apparatus according to claim 15 wherein each coupling slider has a knuckle joint for connection to a respective connecting rod.

19. An apparatus according to claim 15 further comprising a restraint mechanism to prevent the apparatus spinning around the axis of the z crank.

20. An apparatus according to claim 19 wherein the restraint mechanism comprises a lower annular gear restraint and wherein the connecting rods operate within the lower annular gear restraint.

21. An apparatus according to claim 20 wherein the lower gear restraint is constructed from a non-metallic composite material.

22. An axial motor according to claim 7 wherein the coupling sliders are configured to rotate to a limited extent within the respective support arms about respective axes aligned with the reciprocating directions in response to movement of the thrust means.

23. An axial motor according to claim 9 wherein a pivot axle from each connecting rod extends through the respective knuckle joint, with the pivot axle lying substantially transverse to the reciprocating direction of the respective coupling slider.

24. An apparatus according to claim 18 wherein each knuckle joint is configured to receive a pivot axle from a respective connecting rod such that the pivot axle will lie substantially transversely to the reciprocating direction of the respective coupling slider.

25. An apparatus according to claim 16 wherein the coupling sliders are configured to rotate to a limited extent within the respective support arms about respective axes aligned with the reciprocating directions in response to movement of the thrust means.

26. An apparatus according to claim 22 wherein each coupling slider and each coupling support arm comprise wave shaped annular bearing surfaces configured to accommodate the reciprocating motion and rotation of the couplings in the support arms.

27. An apparatus according to claim 25 wherein each coupling slider and each coupling support arm comprise wave shaped annular bearing surfaces configured to accommodate the reciprocating motion and rotation of the couplings in the support arms.

28. An apparatus according to claim 15 wherein a fluid damper is associated with each coupling slider to damp the reciprocating motion of the coupling sliders relative to the respective coupling support portions.

29. An apparatus according to claim 28 wherein each fluid damper comprises a cavity configured for receipt of a damping fluid.

30. An apparatus according to claim 29 wherein each said cavity configured for receipt of a damping fluid is in fluid communication with the z crank coupling, such that damping fluid from a coupled z crank can damp and lubricate the reciprocating movement of the coupling sliders.

31. An apparatus according to claim 29 wherein each coupling slider and a respective coupling support portion form a piston and cylinder arrangement, with each cavity formed within a respective piston and cylinder arrangement.

32. An apparatus according to claim 31 wherein the coupling sliders are arranged to reciprocate within bearing surfaces, and wherein reciprocation of the coupling sliders pumps fluid from said cavities configured for receipt of a fluid to lubricate the bearing surfaces.

* * * * *

UNITED STATES PATENT AND TRADEMARK OFFICE

CERTIFICATE OF CORRECTION

PATENT NO. : 7,117,828 B2
APPLICATION NO. : 10/484590
DATED : October 10, 2006
INVENTOR(S) : Richard Jack Shuttleworth It is certified that error appears in the above-identified patent and that said Letters Patent is hereby corrected as shown below:

On The Title Page, Item -56- page (2)

Under the heading "U.S. PATENT DOCUMENTS":
After "4,300,274 A 11/1981 Papst", insert -- 4,313,404 A 2/1982 Kossel et al. --, On The Title Page, Item -56- Page (2)
Under the heading "FOREIGN PATENT DOCUMENTS":
After "GB 2338746 12/1999", insert the following:
-- JP 5414684 6/1975
JP 63006730 2/1988
JP 02181079 7/1990
JP 11006478 1/1999 --
After "WO 9859160 12/1998", insert -- WO 0025012 5/2000 --.

Signed and Sealed this

Fifth Day of June, 2007

JON W. DUDAS
*Director of the United States Patent and Trademark Office*